US007990032B2

(12) United States Patent
Downing et al.

(10) Patent No.: US 7,990,032 B2
(45) Date of Patent: Aug. 2, 2011

(54) ELECTRON MULTIPLIERS AND MICROCHANNEL PLATES

(75) Inventors: R. Gregory Downing, Niskayuna, NY (US); W. Bruce Feller, Tolland, CT (US); P. Brian White, Palmer, MA (US); Paul L. White, Sturbridge, MA (US)

(73) Assignee: Nova Scientific, Inc., Starbridge, MA (US)

( * ) Notice: Subject to any disclaimer, the term of this patent is extended or adjusted under 35 U.S.C. 154(b) by 55 days.

(21) Appl. No.: 12/409,297

(22) Filed: Mar. 23, 2009

(65) Prior Publication Data

US 2009/0179542 A1 Jul. 16, 2009

Related U.S. Application Data

(60) Division of application No. 11/671,339, filed on Feb. 5, 2007, now Pat. No. 7,508,131, which is a continuation of application No. 10/855,249, filed on May 27, 2004, now Pat. No. 7,183,701.

(60) Provisional application No. 60/474,547, filed on May 29, 2003.

(51) Int. Cl.
*H01J 43/06* (2006.01)

(52) U.S. Cl. ..... 313/103 R; 313/103 CM; 313/528; 250/214 VT

(58) Field of Classification Search ..... 313/103 R, 313/309, 336, 311, 351, 495–497, 523–528, 313/103 CM; 250/215 VT, 214 VT
See application file for complete search history.

(56) References Cited

U.S. PATENT DOCUMENTS

| | | | |
|---|---|---|---|
| 3,603,828 | A | 9/1971 | Sheldon |
| 3,634,713 | A | 1/1972 | Foote |
| 3,814,977 | A | 6/1974 | Simms |
| 3,939,374 | A | 2/1976 | Schagen et al. |
| 4,323,811 | A | 4/1982 | Garfield |
| 5,086,248 | A | 2/1992 | Horton et al. |
| 5,374,864 | A | 12/1994 | Roy et al. |
| 5,391,101 | A | 2/1995 | Aebi et al. |
| 5,493,111 | A | 2/1996 | Wheeler et al. |
| 5,565,729 | A | 10/1996 | Faris et al. |
| 5,568,013 | A | 10/1996 | Then et al. |
| 5,624,706 | A | 4/1997 | Goukassian |
| 5,939,613 | A | 8/1999 | Naaman et al. |
| 6,384,519 | B1 | 5/2002 | Beetz et al. |
| 6,455,987 | B1 | 9/2002 | Durst et al. |
| 6,545,281 | B1 | 4/2003 | McGregor et al. |
| 6,828,714 | B2 | 12/2004 | Downing et al. |
| 2003/0205956 | A1 | 11/2003 | Downing et al. |
| 2004/0164250 | A1 | 8/2004 | Cork et al. |

FOREIGN PATENT DOCUMENTS

| | | |
|---|---|---|
| EP | 592186 A1 | 4/1994 |
| GB | 1217477 | 12/1970 |

OTHER PUBLICATIONS

"Fast Neutron Imaging", University of Leiceister, Microchannel Plate Group, www.sre.le.ac.uk/mcp/neutron.html, updated Jul. 2001.

(Continued)

*Primary Examiner* — Joseph L Williams
(74) *Attorney, Agent, or Firm* — Fish & Richardson P.C.

(57) ABSTRACT

An electron multiplier can be fabricated by depositing an electron emissive material on a reticulated substrate, and forming the reticulated substrate into the electron multiplier.

24 Claims, 13 Drawing Sheets

OTHER PUBLICATIONS

"MCP Optics", University of Leiceister, Microchannel Plate Group, www.src.le.ac.uk/mcp/optics/mcp-optics.html, updated Jul. 2001.
"Microchannel Plate", Photonics Products, New Product Announcements, www.photonics.com/Spectra/NewProds/apr01/dPlate.html, Apr. 2001.
"Technical Brief, #1-Dynamic Range", Scientific Detector Products Technical Briefs, Burle Industries, Inc., www.burle.com/dettechbrief_1.htm, 2001.
"Microchannel Plate Imaging Neutron Detector", Nova Scientific, Inc., www.bmdotechnology.net/techsearch.asp?articleid=515, 2000-2001.
Ron Naaman, "An electron multiplier capable of working at low vacuum: The microsphere plate", Rev. Sci. Instrum. 67 (9), Sep. 1996.
"Longscale Microchannelplate F6492", Hamamatsu, 1997.
"Ion Detectors", Scimedia:Ion Detectors, http://elchem.kaist.ac.kr/vt/chem-ed/ms/detector/detector.htm, 1996.
Tremsin et al., "The Microsphere Plate: a new type of electron multiplier", Nuclear Instruments and Methods in Physics Research A. 368 (1996) 719-730.
Joseph Ladislas Wiza, "Microchannel Plate Detectors", Nuclear Instruments and Methods, vol. 162, 1979, pp. 587-601.
Fraser et al., "Thermal neutron imaging using microchannel plates", Neutrons, X-rays and Gamma Rays: Imaging Detectors, Materials Characterization Techniques and Applications, SPIE Proceedings, vol. 1737, Jul. 21-22, 1992, San Diego, CA.
"Microchannel Plate (MCP)" www.hpk.co.jp/eng/products/Etd/MCPE.htm, retrieved Jan. 9, 2002.
"Microchannel Plate Imaging Detectors", www.nasatech.com/ITB/Fr/T7_330.html, retrieved Jan. 9, 2002.
"Microchannel Plate Principles of Operation", http://hea-www.harvard.edu/HRC/mcp/mcp.html, retrieved Jan. 9, 2002.
Greg Downing et al., "Neutron Detection and Imaging using Microsphere Plates", Nova Scientific, Inc., Jun. 20, 2001.
El-Mul Technologies, http://el-mul.co.il, retrieved Jun. 23, 1999.
MicroSphere Plates, www.tectra.de/e/detect.htm, updated Sep. 28, 1999.
Bradley, Peter D., "The development of a Novel Silicon Microdosimeter for High LET Radiation Therapy", University of Wollongong, Department of Engineering Physics, 2000.
PCT International Search Report dated Mar. 23, 2004 (3 pages).

ELECTRON MULTIPLIERS AND MICROCHANNEL PLATES

CLAIM OF PRIORITY

This application is a divisional (and claims the benefit of priority under 35 U.S.C. §121) of U.S. patent application Ser. No. 11/671,339, filed on Feb. 5, 2007 now U.S. Pat. No. 7,508,131, which is a continuation (and claims the benefit of priority under 35 U.S.C. §120) of U.S. patent application Ser. No. 10/855,249, filed May 27, 2004 (issued as U.S. Pat. No. 7,183,701), which claims priority under 35 U.S.C. §119(e) to U.S. patent application Ser. No. 60/474,547, filed on May 29, 2003. The entire contents of the above applications are hereby incorporated by reference.

TECHNICAL FIELD

The invention relates to electron multipliers and radiation detectors.

BACKGROUND

An electron multiplier can be formed by bonding a perforated or porous plate, e.g., a lead glass plate, between an input electrode and an output electrode, and providing a high voltage direct current (DC) field between the electrodes. When incident particles, such as electrons, ions, or photons, strike the input electrode and collide against glass surfaces within the plate, electrons, sometimes called "secondary electrons", are produced. The secondary electrons are accelerated by the DC field toward the output electrode, and collide against other surfaces within the plate to produce more secondary electrons, which can in turn produce more electrons as they accelerate through the plate. As a result, an electron cascade or avalanche can be produced as the secondary electrons accelerate through the plate and collide against more surfaces, with each collision capable of increasing the number of secondary electrons. A relatively strong electron pulse can be detected at an output face.

Electron multipliers commonly include two types of plates: microchannel plates (MCPs) and microsphere plates (MSPs). Microchannel plates (MCPs) typically include a glass plate perforated with a regular, parallel array of microscopic channels, e.g., cylindrical and hollow channels. Each channel, which can serve as an independent electron multiplier, has an inner wall surface formed of a semi-conductive and electron emissive layer. As incident particles enter a channel and collide against the wall surface to produce secondary electrons, a cascade of electrons can be formed as the secondary electrons accelerate along the channel (due to the DC field), and collide against the wall surface farther along the channel, thereby increasing the number of secondary electrons. Microsphere plates (MSPs) typically include a glass plate formed of microscopic glass spheres that have semi-conductive and electron emissive surfaces. The spheres are packed and bonded together, e.g., by compression and sintering. As incident particles collide against the surfaces of the spheres to form secondary electrons, a cascade of electrons can be formed as the secondary electrons accelerate through the interstices defined by the spheres and collide against the surfaces of other spheres.

SUMMARY

The document describes electron multipliers and radiation detectors.

In general, in one aspect, a method of making an electron multiplier includes depositing an electron emissive material on a reticulated substrate; and forming the reticulated substrate into the electron multiplier.

Implementations can include one or more of the follow features. The electron emissive material can include glass including lead. The glass can include a material selected from the group consisting of silicon carbide, boron nitride, boron carbide, carbon, borosilicate glass, lithium glass, gadolinium glass, $^{3}$He, $^{6}$Li, $^{10}$B, $^{113}$Cd, $^{149}$Sm, $^{151}$Eu, $^{155,157}$Gd, U, $^{1,2,3}$H, and Pb. The reticulated substrate can include a material selected from the group consisting of silicon carbide, boron nitride, boron carbide, carbon, borosilicate glass, lithium glass, gadolinium glass, $^{3}$He, $^{6}$Li, $^{10}$B, $^{113}$Cd, $^{149}$Sm, $^{151}$Eu, $^{155,157}$Gd, U, $^{1,2,3}$H, and Pb. The reticulated substrate can be made of an insulator. The reticulated substrate can be made of a semi-conductive material. The method can include positioning the reticulated substrate between an input electrode and an output electrode of the electron multiplier, the input and output electrodes to generate the electric field across the substrate. The reticulated substrate can include a network of cells or passages that extend between the input and output electrodes. The input electrode can be opaque to light. The reticulated substrate can include a foam substrate.

In general, in another aspect, a method of making an electron multiplier includes depositing an electron emissive material on a reticulated substrate, in which the electron emissive material generates secondary electrons upon receiving at least one of neutrons, alpha particles, beta particles, and gamma rays; and forming the reticulated substrate into the electron multiplier.

Implementations can include one or more of the follow features. The method can include positioning the reticulated substrate between an input electrode and an output electrode of the electron multiplier, the input and output electrodes to apply a direct current field across the substrate. The reticulated substrate can include a network of cells or passages that extend between the input and output electrodes. The substrate can include an insulator or a semi-conducting material.

In general, in another aspect, an electron multiplier includes an elongated electrode; and a structure surrounding a portion of a cross section of the electrode, the structure comprising randomly interconnected fibers, shards, or spheres.

Implementations can include one or more of the follow features. The electrode can be a wire. The structure can completely surround a cross section of the electrode. The structure can be spaced from the electrode. The multiplier can further include a hydrogen-containing material on a portion of the structure. The hydrogen-containing material can include a polymer. The multiplier can include a plurality of electrodes. The electrodes can be symmetrically arranged about a cross section of the multiplier. The electrode and the structure can be coaxial. The structure can have a circular cross section. The structure can have a polygonal cross section. The structure can include a neutron sensitive material. The structure can include an electron emissive material. The structure can include lead. The electrode can include a negative electrode. The electrode can include a positive electrode.

These and other aspects and features, and combinations of them, may be expressed as methods, apparatus, systems, means for performing functions, and in other ways.

These aspects, features, systems, and methods may include one or more of the following advantages. The plates can have good mechanical properties, such as relatively good rigidity and/or toughness. The plates can be used as an MCP. The plates can be used in a neutron detector or a neutron imager to provide efficient neutron detection and good spatial resolution. The plates can be used in a hard X-ray (e.g., >10 keV) detector or imager to provide efficient hard X-ray detection and good spatial resolution. The plates can be used in gamma ray (e.g., >100 keV) detectors. The plates can be fabricated into very large area formats. The plates can be curved or shaped to match focal plane requirements.

The plates and detectors described herein can be used as a front surface detector for UV, ions, electrons, etc., as well as for bulk (neutron and hard X-ray) detection. The plates and detectors described herein can be used for other applications that are generically used for typical MCPs. For example, a large area foam detector with a photocathode coating on the top surface can be used to detect light.

Other aspects, features, and advantages of the invention are in the description, drawings, and claims.

DETAILED DESCRIPTION

Figure 1A:
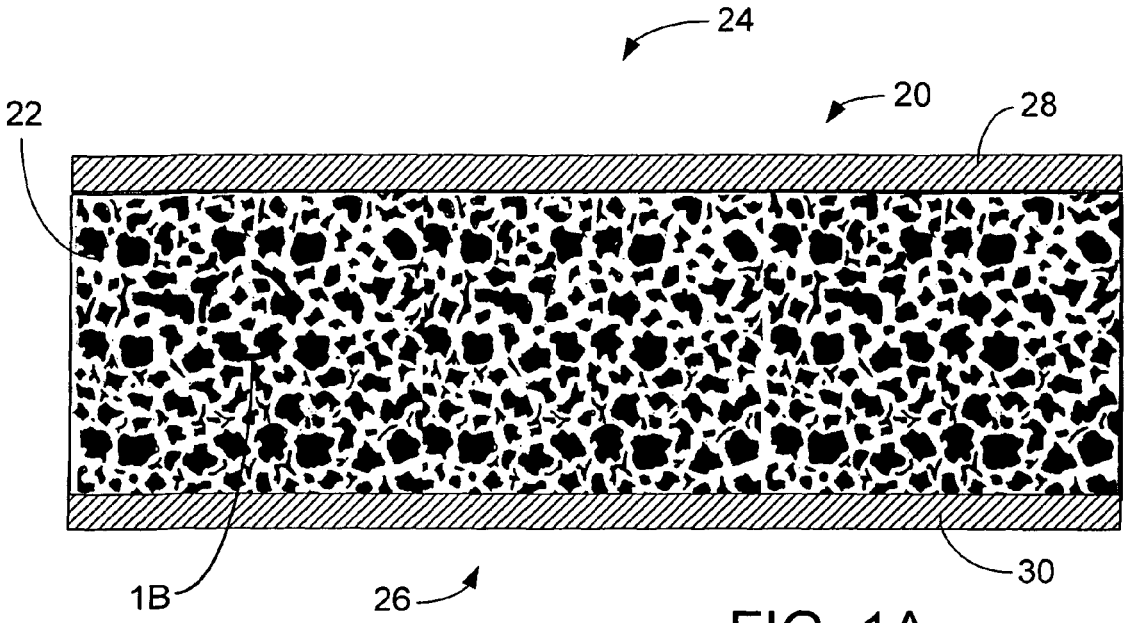
FIG. 1A is a partial, cross-sectional view of an embodiment of an electron multiplier.
Figure 1B:
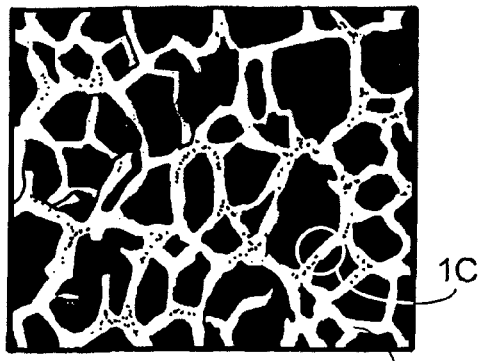
FIG. 1B is a detailed view of the electron multiplier of FIG. 1A.
Figure 1C:
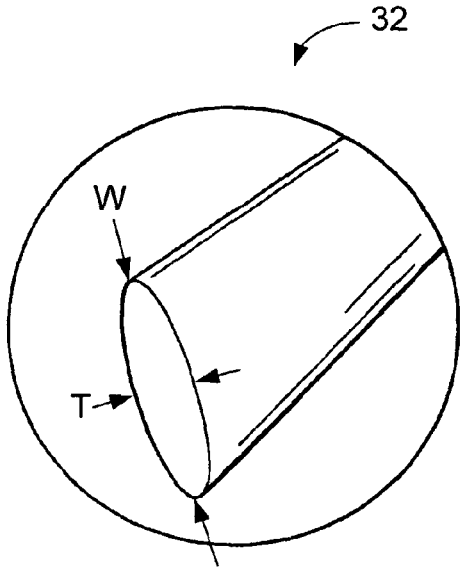
FIG. 1C is a detailed view of the electron multiplier of FIG. 1B.

Referring to FIGS. 1A-1C, an electron multiplier 20 is shown. Multiplier 20 includes a plate 22 having an input side 24 and an output side 26, an input electrode 28 bonded to the input side, and an output electrode 30 bonded to the output side. Electrodes 28 and 30 are configured to provide a direct current field (as shown, across plate 22 and generally normal to the electrodes) to accelerate secondary electrons generated during use toward output electrode 30. As shown in FIGS. 1A and 1B, plate 22 has a complex, reticulated structure like that of an open-cell foam. The microscopic network structure of plate 22 can resemble the microscopic structure of a sponge or of cancellous bone, slightly bonded felt, or three-dimensional layers of netting. The structure includes a network of cells or passages that extend between electrodes 28 and 30. In some embodiments, the cells are defined by a multitude of interconnected fibers or ribs 32 that include a bulk material capable of absorbing radiation and a surface material capable of releasing free electrons. As shown, portions of fibers 32 have been fused to other fibers; while other portions of fibers 32 not fused to other fibers remain exposed, e.g., to a vacuum or ambient atmosphere. In preferred embodiments, fibers 32 have a structure that, in cross section, maximizes its surface area to volume ratio to enhance the performance of electron multiplier 20.

During use, incident particles (such as photons, atoms, molecules, electrons, ions, or neutrons) interact with (e.g. react on and within) fibers 32 within plate 22, preferably but not exclusively near input electrode 28, and directly produce secondary electrons. Secondary electrons can also be created from intermediary radiation, such as photons, atoms, molecules, electrons, ions, or neutrons. For example, the incident radiation can release electrons directly, or the radiation can react with plate 22 to release radiation that is not an electron and that travels some distance to cause an electron to be released that in turn produces an electron cascade. The secondary free electrons, accelerated toward output electrode 26 by an applied DC field, collide against the surfaces of other fibers as they travel through plate 22, and produce more secondary electrons. As a result, an electron cascade is created, with a relatively large number of electrons exiting plate 22.

In preferred embodiments, fibers 32 have a structure that has a high surface area and a low cross-sectional dimension (e.g., thickness). Having a high surface area increases the geometric possibility that particles escaping from the bulk can pass through and strike against additional fibers. As described below, the high surface area also allows more electron emissive material and/or neutron-sensitive material to be loaded into plate 22. The low cross-sectional dimension (e.g., thinness) provides a geometry in which the distance from the surface of a fiber to the bulk of the fiber is reduced (e.g., minimized). That is, the distance a reaction product, such as a neutron-induced particle, needs to travel to escape from the fiber interior or bulk is relatively small, vis-à-vis, for example, a cylindrically-shaped fiber. As a result, the reaction product can escape easily from the fiber, thereby possibly striking other fibers and producing additional secondary electrons. Thus, fibers 32 are preferably thin and shaped such that the path of each reaction product crosses through or nearly through the surface of a fiber. The cross section of fibers 32 can be any shape, and in embodiments, maintains the features described herein for particle escape. Such configurations also increase (e.g., maximize) the loading of electron emissive material into plate 22 and allow reaction products to easily intersect one or more fiber surface.

At the same time, fibers 32 define a reticulated structure such that plate 22 is capable of functioning as an electron multiplying structure. Typically, for the electron multiplication process to proceed through plate 22, the inter-fiber passages are preferably sufficiently open and spaced to allow a relatively large number of electrons to flow. Relatively open and spaced passages can also enhance plate 22 mechanically. The passages can also enhance plate 22 electrically, allowing relatively strong electric field gradients to be supported, allowing relatively high secondary electron energies to be attained, and/or leading to effective electron multiplication. Fused fibers that are too closely spaced may constrict the inter-fiber passages into dead ends or into openings too small to support electron multiplication, e.g., the electrons are unable to attain a sufficient energy at impact to create additional secondary electrons.

In some preferred embodiments, fibers 32 form a network in which the fibers are interconnected together by butt end junctions, similar to stove pipe junctions. Near the junctions, fibers 32 preferably tapered down in size and join together, without any increases in mass (which can lower the surface area to cross section ratio). Multiple fibers 32 define cells, or void volumes, through which reaction products travel as they exit the bulk fiber and strike another fiber. The morphology of the cells can be relatively isotropic (for example, as shown in FIG. 1A), or the morphology can be adjusted, e.g., made more anisotropic to control (increase and/or reduce) the gain. For example, as shown in FIG. 1A, as particles (e.g., secondary electrons) travel vertically from the top side 24 to the bottom side 26, it is believed that the particles do not interact strongly (energetically) with fibers that are oriented vertically along plate 22. The vertically-oriented fibers occupy volume in plate 22 but can contribute less significantly to the gain of multiplier 20, depending upon the energy between electron interactions, which is related to the distance between fiber strikes. They strongly contribute to initiating the electron cascade resulting from interaction with external radiation. Thus, in some embodiments, fibers 32 are formed into an anisotropic structure in which the mass of fibers in the horizontal planes is maximized (e.g., by decreasing fiber-to-fiber spacing) and/or the mass of fibers in the vertical planes is minimized (e.g., by decreasing the number of vertically-oriented fibers). For example, the structure of fibers 32 can be similar to that of graphite wherein the c-axis is parallel to the particles' direction of travel. In certain embodiments, the average cell distance, or fiber-to-fiber distance, is about 20 microns to about 150 microns. Optimal cell dimensions can be dependent, for example, on the voltage applied across plate 22 during use.

Referring particularly to FIG. 1C, in certain embodiments, fibers 32 have a ribbon-like form in which the width of the fiber is larger than the thickness of the fiber. As used herein, the widths and thicknesses of fibers 32 are the average widths and thicknesses in plate 22. The particular fiber dimensions can be dependent upon the type of radiation being detected. For neutron detection, bulk detection with a material such as $^{10}$B, $^{6}$Li, $^{155,157}$Gd, or $^{nat}$Gd, or for X-ray detection, bulk detection with a material such as Pb, the thickness (T) of fibers 32 can be, for example, about 2 to about 30 microns. The thickness can be greater than or equal to about 2, 5, 10, 15, 20, or 25 microns; and/or less than or equal to about 30, 25, 20, 15, 10, or 5 microns. The width (W) of fibers 32 can be, for example, about 5 to about 100 microns. The width can be greater than or equal to about 5, 10, 20, 30, 40, 50, 60, 70, 80, or 90 microns; and/or less than or equal to about 100, 90, 80, 70, 60, 50, 40, 30, 20, or 10 microns. For X-ray detection, the thickness of fibers can be, for example, about 5 to about 500 microns. For UV or electron detection, the interaction is a surface-only interaction. The length of fibers 32 is generally greater than the widths or thicknesses. In embodiments, the length of fibers is such that it enhances (e.g., increases) the amount of active material in plate 22, and/or it maintains a distance between the fibers that allows the production of an electron cascade. For example, if fibers 32 are too close, the electron cascade can be quenched. In some embodiments, fibers 32 have a length of about 0.1 mm to about 50 mm. For example, fibers 32 can have a length greater than or equal to about 0.1 mm, 0.5 mm, 1 mm, 5 mm, 10 mm, 15 mm, 20 mm, 25 mm, 30 mm, 35 mm, 40 mm, or 45 mm; and/or less than or equal to about 50 mm, 45 mm, 40 mm, 35 mm, 30 mm, 25 mm, 20 mm, 15 mm, 10 mm, 5 mm, 1 mm, or 0.05 mm. The lengths of fibers 32 may be uniform or relatively random. For example, a 20-micron diameter fiber can include one or more lengths from about 0.3 mm to 10 mm in length. Relatively long fibers 32 can be used for large plates, but relatively short fibers may provide resistance to coiling and a uniform plate.

Alternatively or in addition, fibers 32 can be expressed as having an average width (W) to thickness (T) ratio of between about 1:1 and about 50:1. For example, the width to thickness ratio can be greater than or equal to about 1:1, 5:1, 10:1, 20:1, 30:1, or 40:1; and/or less than or equal to about 50:1, 40:1, 30:1, 20:1, 10:1, or 5:1.

The cross-sectional shape of fibers 32 is not limited. As shown in FIG. 1C, fibers 32 have an oval or elliptical cross section. Other fibers having cross-sectional shapes with high surface areas are possible, such as extruded star-shaped fibers with multiple (e.g., three, four, five, six, seven, eight, nine, ten or more) vertices. Fibers 32 preferably have rounded, smooth surfaces. Sharp edges or points can create "hot spots" that spontaneously emit electrons and create false signals. The length of the rib may not only be linear in shape, but may be wavy, helical, zigzagged, or random along the length in shape or direction between junctions with another rib.

Compositionally, fibers 32 can be a composite of two or more distinct materials, or the fibers can be formed of one homogeneous material. In some embodiments, plate 22 is formed by coating a reticulated substrate with an electron emissive surface material. The foam substrate can be made of a light-weight, structural material, such as building insulation materials. In some cases, the foam substrate can be removed during final processing. The substrate preferably has physical properties, such as heat resistance and conductivity/resistivity, such that it can be formed into an electron multiplier. The foam substrate can include a radiation reactive material (e.g., a neutron sensitive material or an X-ray sensitive material). The foam substrate can include, for example, silicon carbide (e.g., SiC), boron nitride (e.g., BN), boron carbide (e.g., $B_4C$), and/or carbon (e.g., vitreous carbon), borosilicate glass, lithium glass, gadolinium glass or comparable ceramic materials, or a combination of these materials. The substrate may contain one of these materials and also particles or inclusions of highly neutron reactive nuclides and nuclide compounds including but not limited to $^{3}$He, $^{6}$Li, $^{10}$B, $^{113}$Cd, $^{149}$Sm, $^{151}$Eu, $^{155,157}$Gd, and/or U or $^{1,2,3}$H. The boron, lithium, gadolinium or other neutron reactive material may or may not be enriched with the neutron active nuclide to enhance or prevent/avoid neutron interactions. For hard X-ray or gamma ray detection applications, the foam substrate can include, for example, a lead glass or other high atomic number element with high X-ray interaction. Examples of suitable foam substrates are available from ERG Materials and Aerospace Corporation (Oakland, Calif.). Open-cell polymer foams, such as those including nylon, high density polyethylene, or other compounds, can also be used as a starting material. In embodiments, such as those in which the foam substrate is a polymer, the substrate can be removed by heating, leaving a reticulated structure with the desired material remaining in place.

Figure 19A:
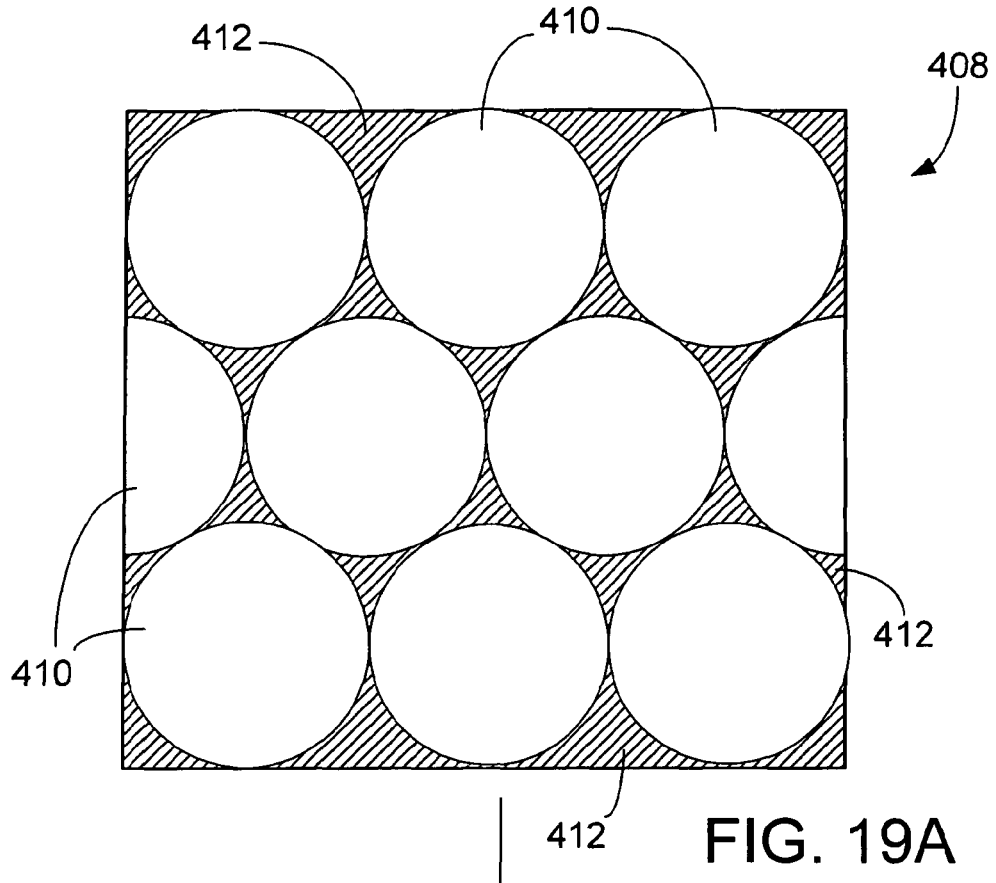
FIGS. 19A and 19B illustrate an embodiment of a method of making a reticulated structure.
Figure 19B:
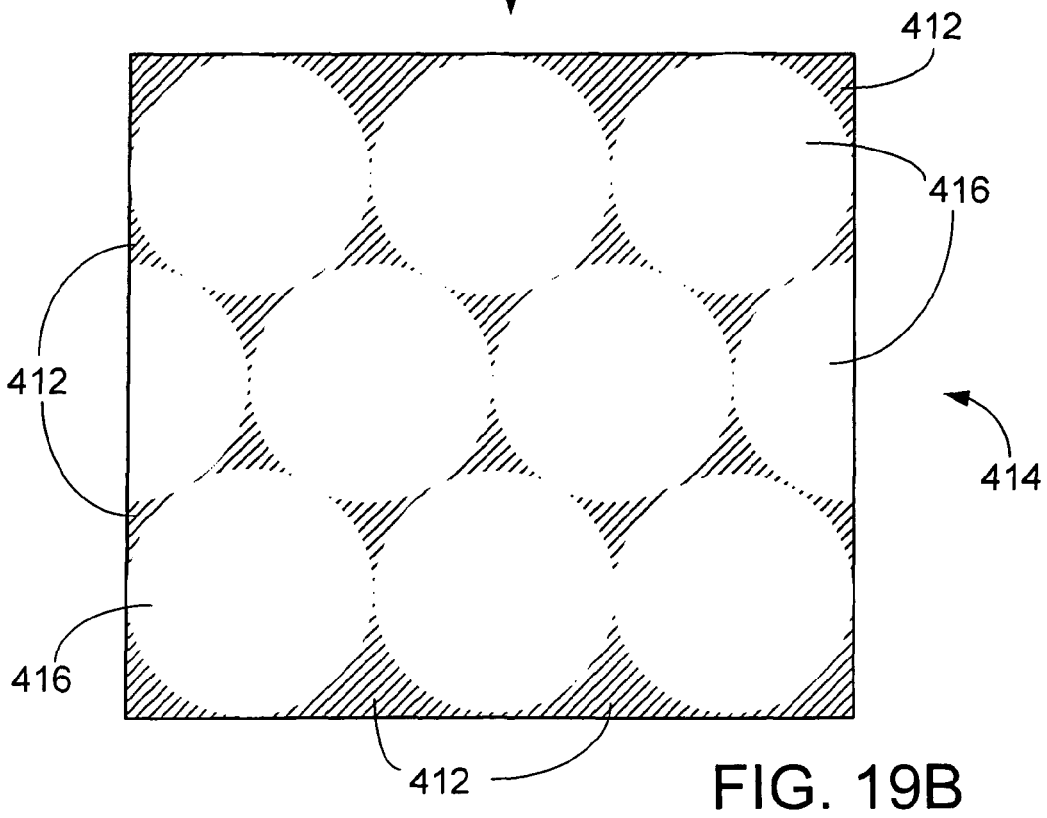
Figure 20:
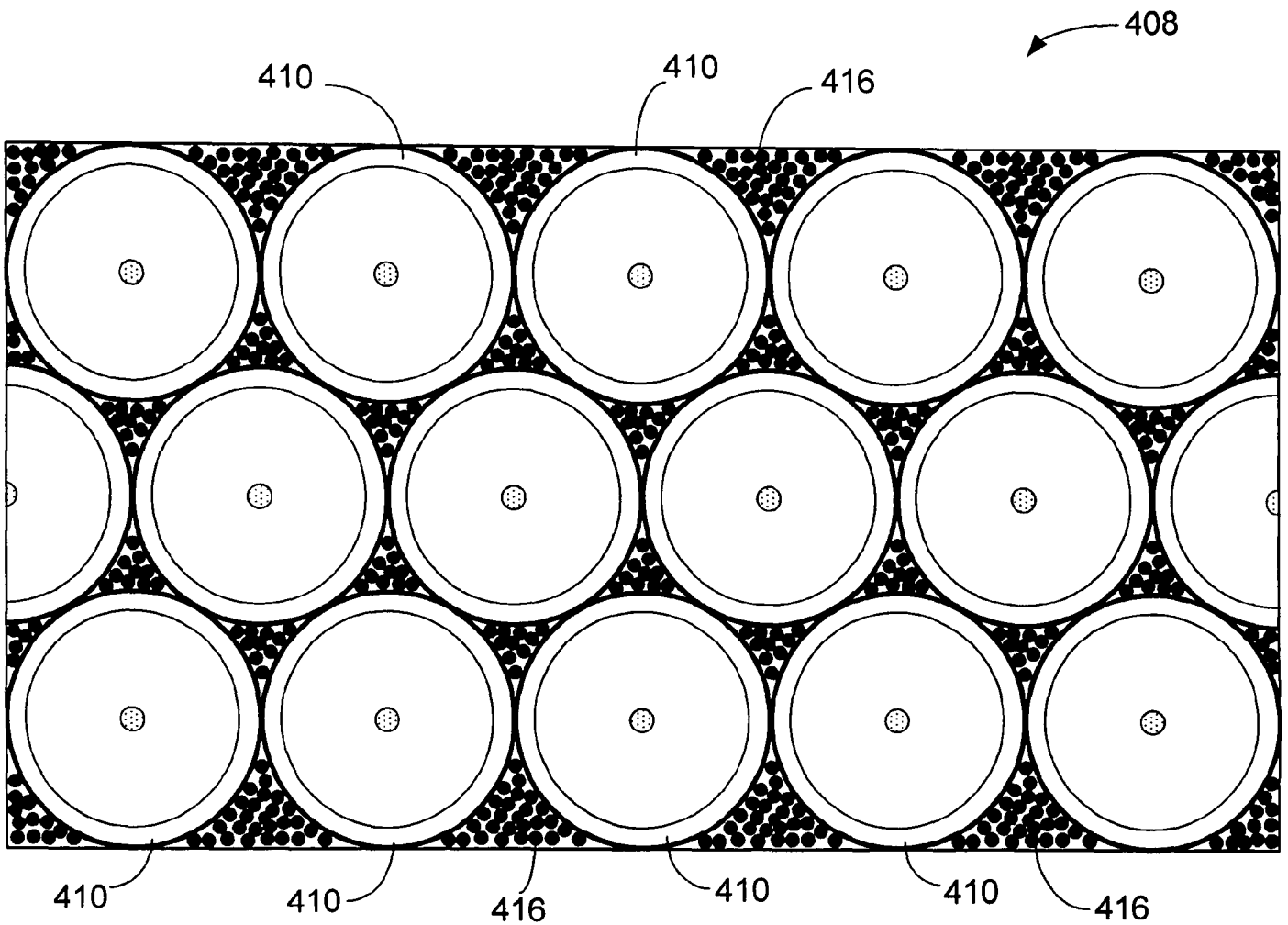
FIG. 20 illustrates an embodiment of a structure for making a reticulated structure.

The reticulated structure can also be made using one or more methods. Referring to FIGS. 19A and 19B, a three-dimensional structure 408 includes a plurality of removable bodies 410 surrounded by electron emissive material 412. As shown, bodies 410 are close-packed spheres, but other shapes, such as oval-shaped bodies or irregularly-shaped bodies, can be used. Bodies 410 can be made of any material that can be selectively removed, such as etchable glass or dissolvable polymers. In some embodiments, bodies 410 can be hollow to shorten the time need to remove the bodies. Referring to FIG. 19B, a reticulated structure 414 can be formed by selectively removing bodies 410 (for example, by etching away or dissolving the bodies), leaving electron emissive material 412 to define voids 416 the reticulated structure. Electron emissive material 412 can be processed (e.g., fused and reduced) as described herein to form an electron multiplier. In other embodiments, referring to FIG. 20, electron emissive material 412 can be spheres 416, fibers (e.g., as described herein), and/or chards of electron emissive material. Embodiments of spheres, fibers, and chards are described, for example, in U.S. Ser. No. 10/138,854.

The electron emissive material can be any material capable of-producing secondary electrons. The electron emissive material may or may not contain (e.g., be blended with) one or more radiation reactive material (such as an X-ray sensitive material or neutron absorbing nuclides). In some embodiments, the emissive material includes glass combined with lead, e.g., in the form of at least 20 weight percent lead oxide. The glass can be heated in a reducing atmosphere, e.g., hydrogen, to form a semi-conductive and electron-emissive surface. Without wishing to be bound by theory, it is believed that this reduction step produces a first region adjacent to the surface of the material that is relatively depleted of or poor in lead, and a second region farther away from the surface of the fibers that is relatively enriched or locally elevated with lead. The lead concentrations as described are relative to the average lead concentration of unreduced lead glass fibers. It is believed that the semi-conductive and electron-emissive surface layer extends to about 200 nanometers from the surface of the fibers. Other semiconducting glasses may also be used, e.g., iron borates or bulk conducting vanadate phosphates.

The foam (reticulated) substrate can be coated with the electron emissive material using one or more techniques. Suitable techniques include solution or sol-gel methods or vapor deposition, such as chemical vapor deposition or physical vapor deposition, such as sputtering. Another technique is a glass frit technique in which a fine powder of the electron emissive material is applied (dry or liquid) to the foam substrate, shaken to allow the electron emissive material to penetrate the foam, and heated to melt the material and coat the foam. The coating can be assisted by electrical plating, electrostatic, or ion implantation methods. In some embodiments, the electron emissive material (e.g., an MCP glass or an alkali-lead-silicate) is about a few thousand angstroms thick. The thickness of the electron emissive material can be thick enough to provide a continuous coating over the surface of the substrate, which can be a function of the type of material used. The coating can allow electrons from the fiber side of the coating to flow into the coating to replenish the electrons lost or donated to the electron cascade occurring in the voids between the fibers. In some cases, the coating is thick enough to weakly conduct electrons between the input electrode 28 and output electrode 30. The thickness of the electron emissive material can be greater than or equal to about 100, 500, 1,000, 1,500, 2,000, 2,500, 3,000, 3,500, 4,000, 4,500, 5,000, 10,000, 15,000 angstroms, and/or less than or equal to about 20,000, 15,000, 10,000, 5,000, 4,500, 4,000, 3,500, 3,000, 2,500, 2,000, 1,500, 1,000, or 500 angstroms. The electron emissive material is form such that a differentiated layer of basically two parts can be formed by the hydrogen reduction process (described below): (1) a superficial secondary electron generating layer (e.g., a few hundred angstroms thick at most of mainly an insulator (such as vitreous silica), and (2) a semiconducting layer (e.g., a few thousands angstroms thick) under the superficial secondary electron generating layer that conducts free electrons and resupplies the superficial secondary electron generating layer—filling the holes left behind as secondary electrons escape, e.g., into the vacuum.

Other methods of making plate 22 are possible. For example, the electron emissive and radiation reactive material described above can first be extruded as cylindrically shaped fibers. Then, the cylindrically shaped fibers can be heated until the malleable, and deformed (such as be stretching and/or compressing) to form, for example, ribbon-like fibers. Plate 22 can then be formed by placing the deformed fibers in a liquid carrier, allowing the fibers to fall on a substrate, and drying the fibers to form a flexible mat. The liquid carrier can be, e.g., a solution having properties of specific densities, pH, viscosities or other characteristic to facilitate the uniform distribution of fibers. The substrate can be, e.g., a porous or adsorbent surface such that the liquid can be removed with minimal disturbance to the distribution of the fibers. In other embodiments, the deformed fibers can be mixed with a binder, e.g., amyl acetate or collodion (a nitrocellulose), and the mixture is pressed in a die and collar set using an anvil press to form a mat.

Subsequently, a load can then placed on top of the mat of fibers. The loaded mat can be placed into a controlled atmosphere furnace and heated at a relatively low temperature, in air or oxygen to remove the binder (or carrier) from the mat while preserving the structural integrity of the mat. Then, the mat can be heated at a higher temperature, such as the softening temperature of fibers. While generally retaining their structural integrity, the fibers can fuse together where they touch or are in close proximity to form a plate. A mechanical stop or shim can be used to control the final desired dimensions and/or density.

After the fibers are fused, the plate can be heated in a reducing atmosphere, e.g., hydrogen, to form the semi-conductive and electron-emissive surface layer on the fibers. The conditions used to form the plate, such as temperatures and heating times, can be optimized, for example, as a function of the composition and physical properties, e.g., lead oxide content and glass transition temperature, of the fibers.

In other embodiments, the cylindrically-shaped fibers can be formed into a mat. When the fibers are subsequently heated and fused, the mat can be deformed, for example, stretched and/or compressed, to deform the fibers, for example, into ribbon-like fibers. The fibers can then be reduced as described above.

Plate 22 can be formed in a variety of configurations. Plate 22 can be substantially flat, curved, or hemispherical, and of uniform or non-uniform thickness. To form a curved plate, for example, a mat of fibers 22 can be placed on an appropriated-shaped steel mold, and heated to soften the mat, thereby allowing the mat to conform to the mold. A load may be placed on the mat to help the mat conform to the mold. Plate 22 can be circular or non-circular, e.g., oval, or regularly or irregularly polygonal having 3, 4, 5, 6, 7, or 8 or more sides. In some embodiments, plate 22 can include cutouts and/or holes. Plate 18 can have a thickness of, for example, from about several microns to about ten mm.

After plate 22 is formed, electrodes 28 and 30 can be formed on input and output sides 24 and 26, respectively. Electrodes 28 and 30 can be layers of conductive materials, vacuum deposited by evaporation or sputtering and using fixtures. Suitable materials for electrodes 28 and 30 include, for example, Nichrome™ (a Ni—Cr alloy) and gold. Different materials may be used to form electrodes 28 and 30. Electrodes 28 and 30 can cover substantially all or a portion of input and output sides 24 and 26, respectively. In some embodiments, electrodes 28 and 30 have a thickness of about 1000 Angstroms to about 3000 Angstroms. The thickness can be uniform or non-uniform, and the thickness of electrodes 28 and 30 can be the same or different.

Figure 2:
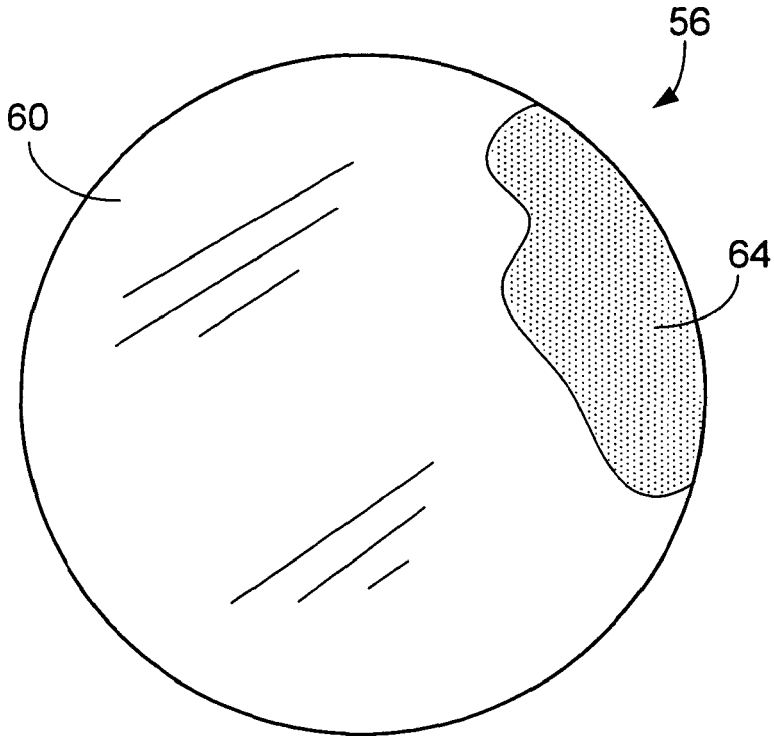
FIG. 2 is a top view of an embodiment of an electron multiplier.
Figure 3:
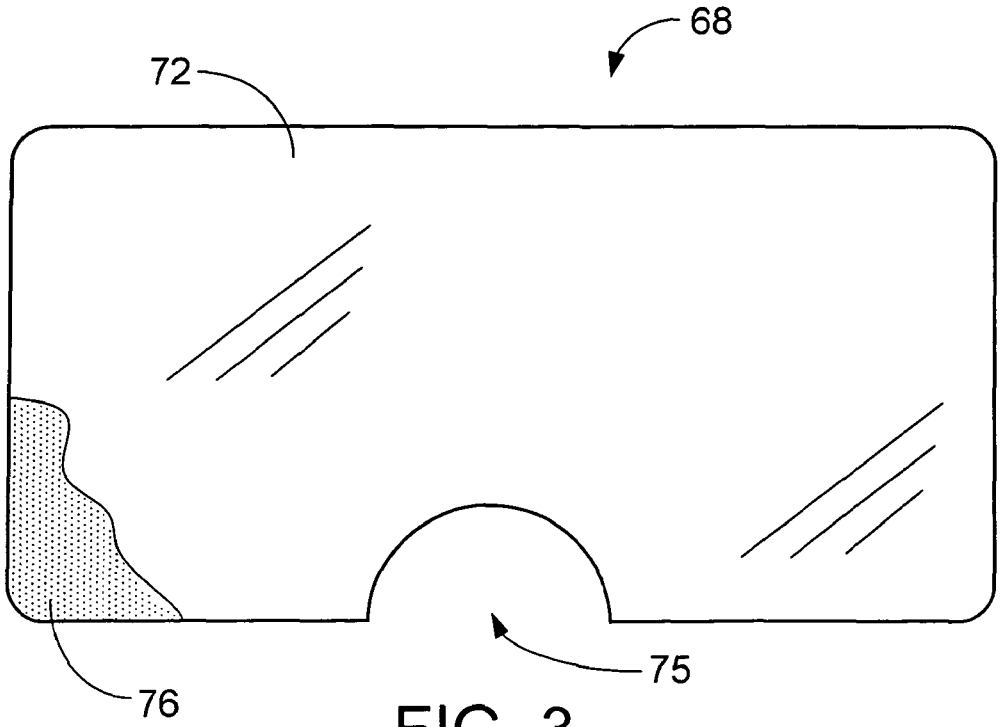
FIG. 3 is a top view of an embodiment of an electron multiplier.
Figure 4:
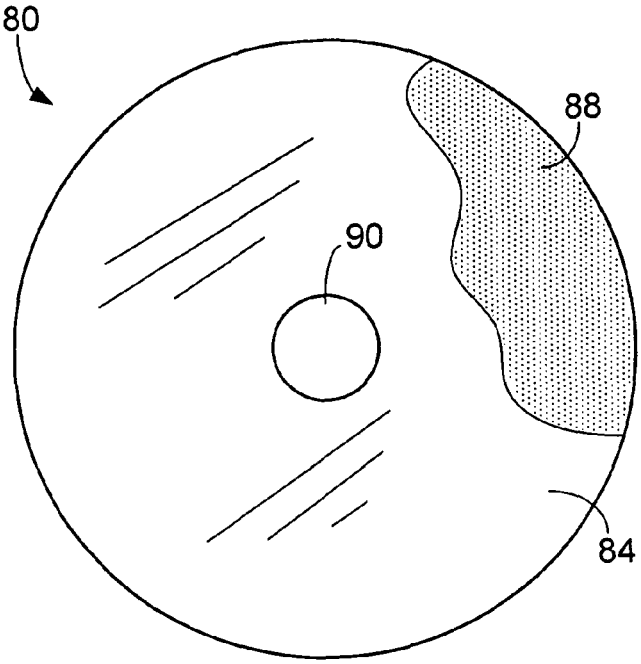
FIG. 4 is a top view of an embodiment of an electron multiplier.

Referring to FIGS. 2-4, embodiments of electron multipliers are shown. FIG. 2 shows a flat and circular electron multiplier 56 having a plate 64 and an electrode 60 covering the plate. FIG. 3 shows a flat and irregularly shaped electron multiplier 68 having a plate 76, an electrode 72 covering the plate, and notch 75 in the side of the multiplier. Electron multiplier 68 is capable of functioning as a scattering detector, e.g., when a beam of incident particles is parallel to the detector. Notch 75 allows the beam of radiation to pass by the device without directly interacting with it. Radiation particles not coherent with the beam can stray wider than notch 75 and can be detected. Likewise, radiation particles that scatter from interactions on the back side of multiplier 68 can scatter back into the multiplier and be detected. FIG. 4 shows a circular and flat electron multiplier 80 having a plate 88, an electrode 84 covering the plate, and a circular hole 90 at the center of the multiplier. Electron multiplier 80 is capable of allowing a primary beam of radiation, e.g., photons, electrons, neutrons, atoms, molecules, and/or ions to pass through hole 90 to strike a target, while electron multiplier 80 detects back-scattered primary particles and secondary particles. Hole 90 allows a beam of radiation to pass by the device without directly interacting with it. Radiation particles not coherent with the beam can stray wider than hole 90 and be detected. Likewise, radiation particles that scatter from interactions on the back side of multiplier 80 can scatter back into the multiplier and be detected.

Figure 5:
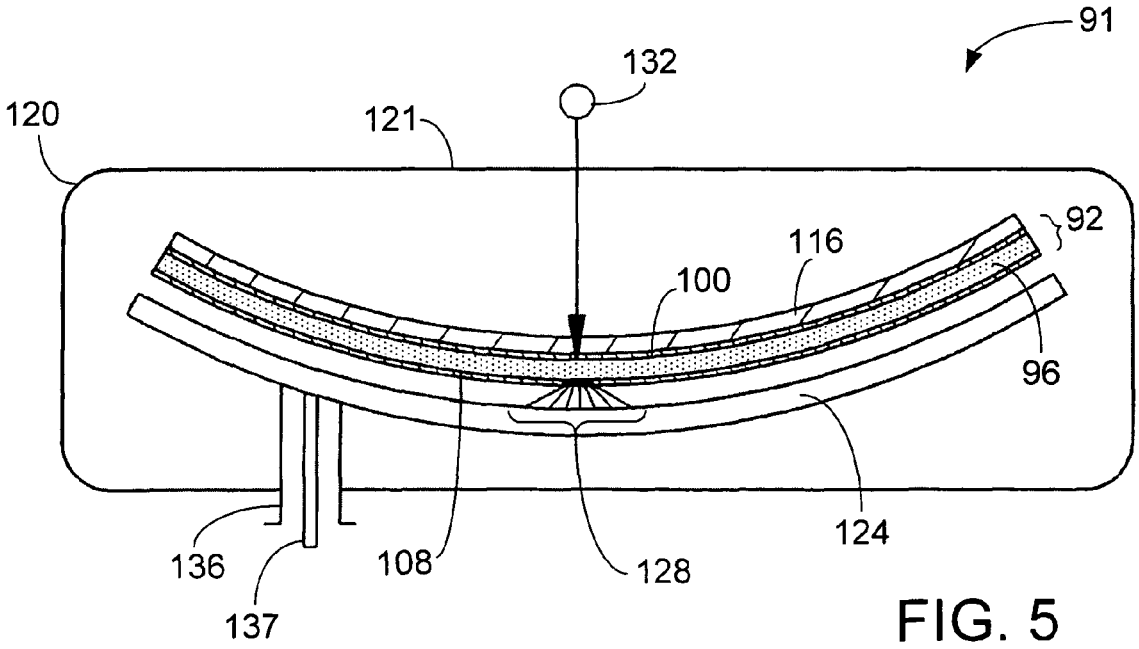
FIG. 5 is a cross-sectional view of an embodiment of an electron multiplier.

FIG. 5 shows a detector 91 having a housing 120, a curved electron multiplier 92, and an electronic readout 124, both enclosed by the housing. Electron multiplier 92 includes a plate 96, bonded to an input electrode 100 and an output electrode 108, as described above. Electron multiplier 92 further includes a curved support 116 connected to input electrode 100 to provide enhanced mechanical support for the multiplier. Housing 120 is capable of maintaining a vacuum and includes a window 121 that is relatively non-reactive, e.g., transparent, to particles 132, such as photons, electrons and neutrons, incident on input electrode 100.

Electronic readout 124 is configured to receive and detect secondary electrons 128 that emerge from output electrode 108 as a result of an electron cascade triggered by incident particles 132. Electronic readout 124, which is shaped to closely match the shape of output electrode 108, is spaced but close to the output electrode. A channel 136, which can be sealed to maintain a vacuum in housing 120, provides an aperture to allow electrical lines 137 to pass from electronic readout 124 (and high voltage electrodes 100, 108) to outside connections, such as to high voltage power supplies and appropriate readout electronics. Support 116 can be made of a material, such as aluminum, sapphire, or Kapton™. Housing 120 can be made of a material, such as aluminum, and window 121 can be made, for example, of aluminum oxide. In other embodiments, electron multiplier 92 is hemispherical or cylindrical.

Plates 64, 76, 88, 96, and their corresponding electrodes, including their methods of manufacture, can be generally the same as plate 22 and electrodes 28 and 30, including their methods of manufacture.

OTHER EMBODIMENTS

Figure 6A:
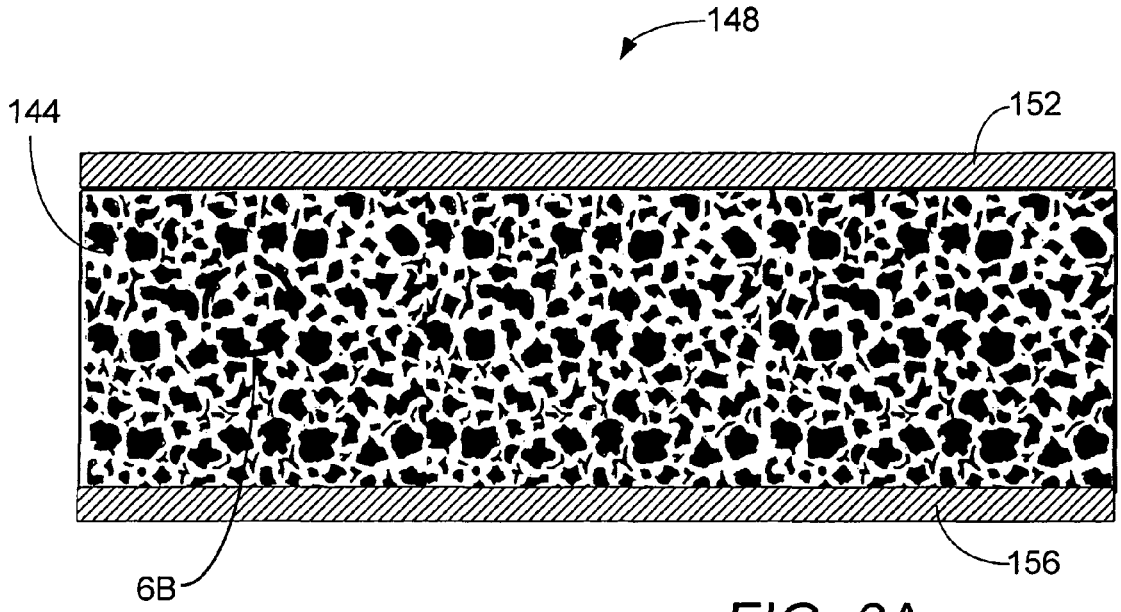
FIG. 6A is a partial, cross-sectional view of an embodiment of an electron multiplier.
Figure 6B:
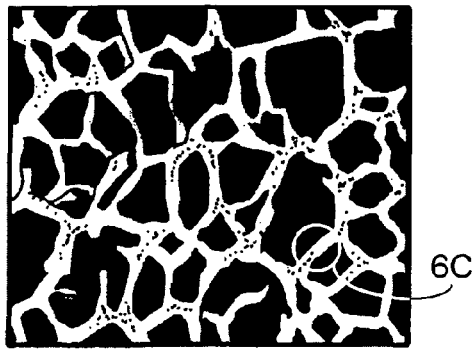
FIG. 6B is a detailed view of the electron multiplier of FIG. 6A.
Figure 6C:
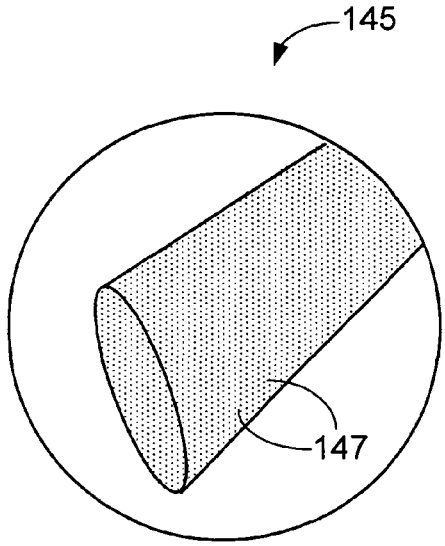
FIG. 6C is a detailed view of the electron multiplier of FIG. 6B.

In other embodiments, an electron multiplier includes a plate having particles, such as the ribbon-like fibers described above, containing at least one neutron-sensitive material that enhances the particles' sensitivity to neutrons, e.g., thermal neutrons. The neutron-sensitive material can be intimately mixed with the material(s) (e.g., glass) of the particles, and/or the neutron-sensitive material can form one or more discrete portion of the particles. The electron multiplier can be used, for example, in neutron detection and/or neutron imaging. Referring to FIG. 6, an electron multiplier 148 includes a plate 144 formed of interconnected ribbon-like particles 145 mixed with at least one neutron-sensitive material 147. Plate 144 is attached to an input electrode 152 and an output 156. Particles 145 can be fibers (as described above). Neutron-sensitive material 147 can include, for example, $^{3}$He, $^{6}$Li, $^{10}$B, $^{113}$Cd, $^{149}$Sm, $^{151}$Eu, $^{155,157}$Gd, and/or U or mixtures of these materials, in excess of their natural abundance. When used in excess of their natural abundance, material 147 can enhance the neutron detection efficiency of particles ribs 145, e.g., compared to the material in its natural abundance.

During use, as incident neutrons penetrate input electrode 152 and particles 145, and react with neutron-sensitive material 147, reaction products are produced, e.g., photons, charged or uncharged particles (such as $^{3}$H, $^{4}$He, $^{3}$He, or $^{7}$Li) or beta particles (such as electrons in the case of $^{155}$Gd or $^{157}$Gd). When hydrogen-containing material, such as high-density polyethylene, Nylon™, or polyaramid is incorporated with plate 144 and/or particles 145, neutron radiation can strike and release energetic protons within the plate and produce secondary electrons. When the site of the reaction or interaction is sufficiently close to the surface of a particle (e.g., a lead glass fiber having an electron-emissive surface), the reaction products escape through the electron emissive surface layer of the particle and cause an emission of secondary electrons. When a beta particle escapes from a particle and collide against another particle, the collision can trigger the release of secondary electrons. A cascade of electrons can be produced and detected, as described above.

Particles 145 may include a range of concentrations of neutron-sensitive material 147. In some embodiments, particles 145 includes between about 0% and about 50% by weight of neutron-sensitive material 147, e.g., greater than about 0% 5%, 10%, 15%, 20%, 25%, 30%, 35%, 40%, or 45%, and/or less than about 50%, 45%, 40%, 35%, 30%, 25%, 20%, 15%, 10%, or 5%. Particulate material incorporated into the rib structure may be up to 100% neutron-sensitive material.

Electron multiplier 148 and plate 144 can be formed and modified as described above for multiplier 20 and plate 22.

Figure 7:
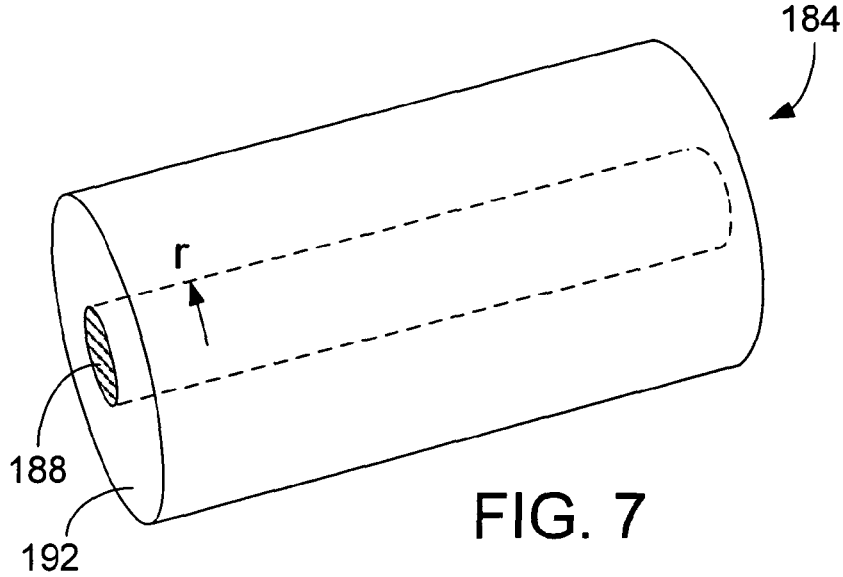
FIG. 7 is an illustration of an embodiment of a fiber.

In other embodiments, neutron-sensitive material 147 forms a discrete portion of a fiber, e.g., a ribbon-like lead glass fiber. Referring to FIG. 7, a fiber 184 contains a core 188 of neutron-sensitive material 147. Core 188 is surrounded by a layer 192 having a semi-conductive and electron-emissive surface layer.

The chemical composition of the fiber may be varied according to distance from the outer surface of the fiber. By decreasing the amount of neutron-sensitive material at depths where neutron-induced reaction products (charged particles, neutrals, and electrons) would be unable to escape to the surface and where such depths exceed the range of these reaction products, a chemical gradient is formed within the particle. Establishing this gradient or preferential layer enriched in neutron-sensitive material can increase the neutron detection efficiency of a detector by preventing neutrons from being absorbed at depths in the particle where they may not be effective and where the reaction products may be unable to escape and thus not contribute to the detection process. This can effectively increase the number of neutrons passing through the particle and increase the probability of such surviving neutrons interacting with other particles. The percentage of neutrons interacting with a given particle that yield a reaction product that escapes the particle to form an avalanche may also be increased.

A preferred maximum radius, r, of core 188 is approximately the distance traveled by a neutron-induced particle, but less than the distance to the outer surface of the layer 192. The thickness of core 188 can be greater or less than the distance traveled by the neutron-induced particle. If the size of core 188 is greater than the range of a neutron-induced particle, the effectiveness of the reactions to produce electron cascades can be decreased. If the radius is less than the range of the induced charged particle, the effectiveness of the reaction to produce electron cascades can be increased. If the radius of core 188 is within the range or greater, a chemical gradient of the neutron sensitive material is preferably formed in which the region farthest away from the outer surface of particle 188 and greater than the range of the neutron induced particles is depleted of or reduced in neutron sensitive material. Layer 192 can have a thickness of several thousand Angstroms. Layer 192 may or may not contain neutron sensitive material. Layer 192 is preferably thick enough to support an electron-emissive layer and an electron conductive layer immediately beneath the electron-emissive layer. The electron conductive layer can replenish electrons lost by the electron-emissive layer. The thickness of layer 192 is typically the same for sphere, fiber, and shard particles. In some embodiments, layer 192 is intimately combined with neutron-sensitive material 147, as described above for particle 145.

Fibers 184 can be formed by drawing a rod of neutron-sensitive material 147 surrounded by a tube of layer 192, e.g., lead glass having an electron-emissive surface layer. Co-drawing the rod and the tube permits them to fuse into a two-component fiber. The fiber can be processed, e.g., cut to length, as previously described. In other embodiments, the foam substrate can be formed to include neutron-sensitive material 147, and the electron emissive layer can be coated on the substrate as described above.

Fibers 145 and/or 184 can be used in electron multipliers having a variety of configurations, e.g., multipliers 10 and as described below.

Figure 8:
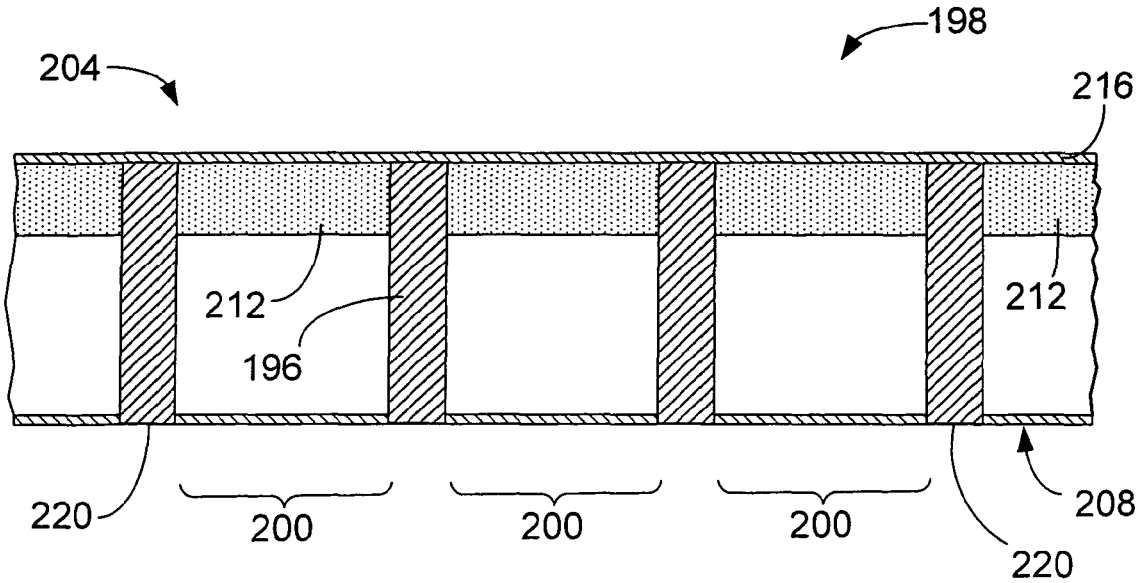
FIG. 8 is a cross-sectional view of an embodiment of a plate.

Referring to FIG. 8, an electron multiplier 198, adapted for neutron detection or neutron imaging applications, includes a plate 196, having a regular array of cylindrical channels 200 oriented normal to an input side 204 and an output side 208 of the plate. Plate 196, e.g., a microchannel plate, is commercially available from Burle Electro Optics, ITT, or Litton. Plate 196, e.g., made of lead glass, includes at least one neutron-sensitive material 147 to enhance the neutron sensitivity of the plate, as described for fibers 145. Channels 200 have a surface layer that is semi-conductive and electron emissive, e.g., by reduction under hydrogen. Plate 196 is constructed by filling channels 200 with small diameter fibers, e.g., fibers 145 and/or 184. Plate 196 can be processed similarly to commercially available electron multipliers.

Figure 9:
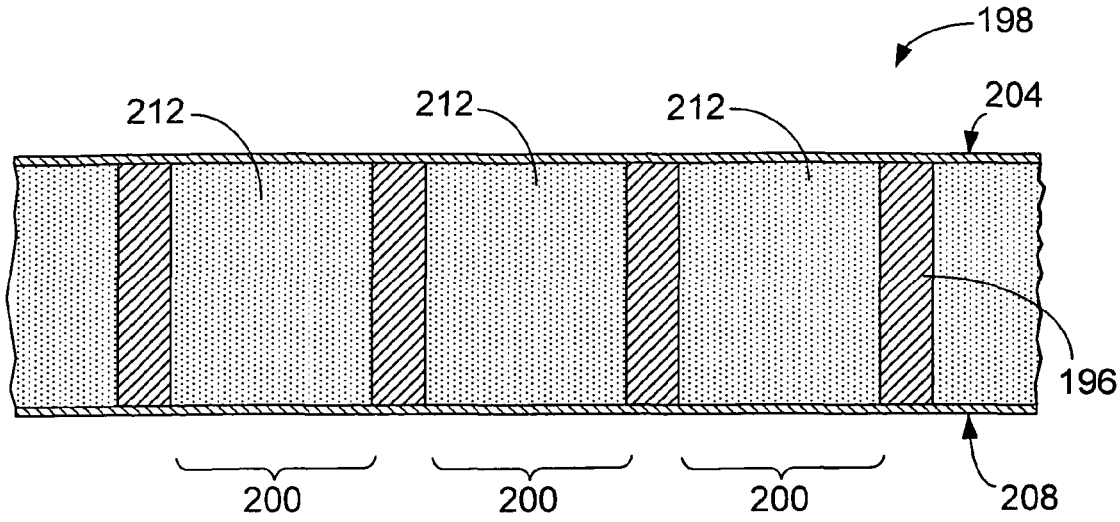
FIG. 9 is a cross-sectional view of an embodiment of a plate.

Electron multiplier 198 further includes fibers 212, e.g., lead glass fibers that fill a portion of at least one channel 200. Fibers 212 can include lead glass, such as that used to enhance an electron cascade, or lead glass containing at least one neutron-sensitive material, such as fibers 145 and/or 184. Fibers 212 can fill an entire channel 200 (FIG. 9), or a portion of the channel, e.g., less than about 100%, 90%, 80%, 70%, 60%, 50%, 40%, 30%, 20% or 10% of the length of the channel, and/or greater than about 0%, 10%, 20%, 30%, 40%, 50%, 60%, 70%, 80% or 90% of the length of the channel. In embodiments in which multiple or all the channels 200 are blocked with fibers 212, the level of blockage can be substantially equal, e.g., for consistent function across the breadth of plate 196. Channels 200 can have different levels of blockage by fibers 212. An input electrode 216 covers input side 204 of plate 196 and fibers 212 that extend to input side 204; and an output electrode 220 covers output side 208 of plate 196. All or a portion of plate 196 or particles 212 can be covered by input electrode 216 or output electrode 220. For example, input electrode 216 may cover input side 204, with or without covering fibers 212 that extend to the input side.

Without wishing to be bound by theory, it is believed that fibers 212 in channels 200 perform at least two functions. Fibers 212 can reduce the reverse flow of ions back through channels 200, which can reduce spurious noise, increase the gain of electron multiplier 198, and/or allow the multiplier to function at relatively high pressures, compared to channels not having the particles. Fibers 212 can also absorb and react with slow neutrons, and permit the products of those reactions to escape from the particles. As a result, secondary electrons can be produced, and an electron cascade can be created within the channel 200. In some embodiments, it is preferable that the electron cascade be triggered as near to input side 208 as possible, so fibers with enhanced neutron sensitivity are grouped in channel 200 near the input side.

Furthermore, electron multiplier 198 is capable of providing good resolution because it contains an array of isolated channel electron multipliers. Electron multiplier 198 can also have reduced false activations caused by ions traveling in the reverse direction of the electron cascade. Fibers 212 also provide plate 196 with structural support, thereby reducing the fragility of the plate.

Figure 10:
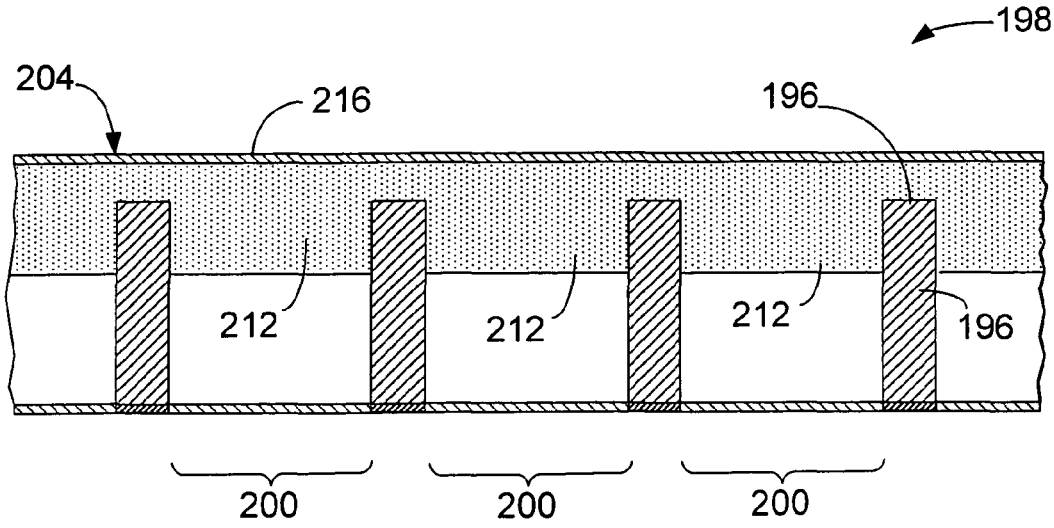
FIG. 10 is a cross-sectional view of an embodiment of a plate.

As shown in FIG. 8, fibers 212 fill channel(s) 200 evenly or flushed with input side 204. Referring to FIG. 10, in other embodiments, fibers 212 extend past channel(s) 200 and cover input side 204. As a result, an increased number of incident particles and/or secondary electrons may enter channel(s) 200, thereby increasing detection efficiency. Extending fibers 212 to cover input side 204 may also simplify manufacture. Fibers 212 can cover substantially all or only a portion of input side 204.

Figure 11:
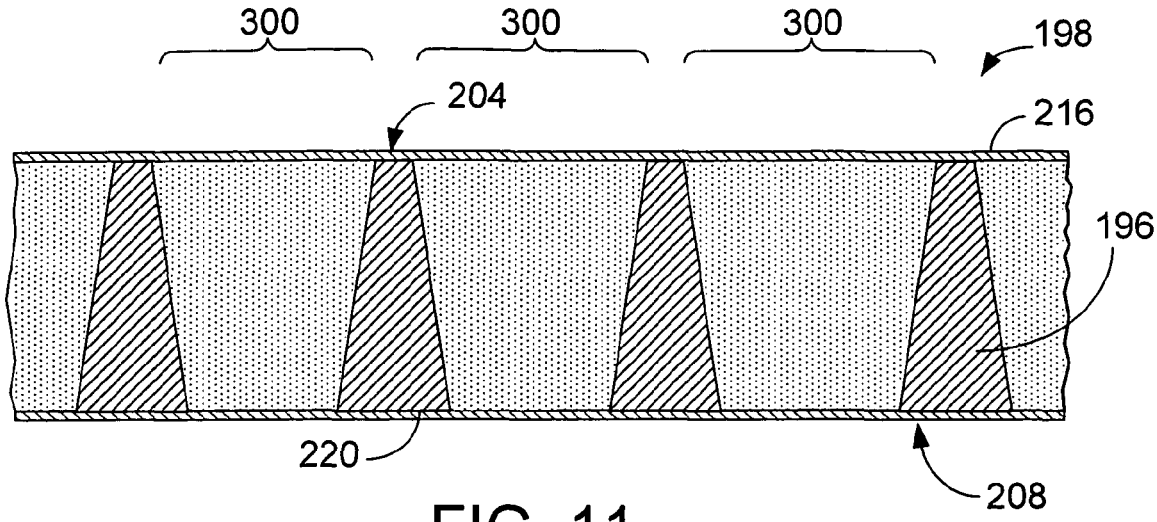
FIG. 11 is a cross-sectional view of an embodiment of a plate.

In certain embodiments, one or more channels 200 have a non-cylindrical shape. Referring to FIG. 11, channels 300 have a frustoconical shape that narrows, e.g., tapers, from input side 204 to output side 208. Channels 200 having frustoconical configurations can be used for expensive or highly configured electronic readouts that are periodically spaced.

Channels 200 can be filled with fibers 212 by dispensing loose fibers over plate 196, blading the fibers into the channels by hand, and subsequently processing the plate as described above (e.g., fusing, reducing, and attaching electrodes). To fix fibers 212 at a predetermined height of channel 200 (e.g., the top ⅓ of the channel), the channel can be first loaded with a small non-fusing ceramic powder, such as $Al_2O_3$ or $SiO_2$ (e.g., in the bottom ⅔ of the channel). The remaining portion of channel 200 (e.g., the top ⅓) can be topped off with fibers 212. Plate 196 can then be heated to fuse fibers 212. The non-fusing ceramic powder remain unfused and can be removed after heating, leaving fibers 212 fused in channel 200. In other embodiments, rather than using loose particles, a paste including fibers 212 can be used.

Fibers 212 may not include any enhancement as to neutron sensitivity, and include semi-conductive and electron-emissive surface layers. In other embodiments, to absorb and react with neutrons, fibers 212 may include a "core" of neutron-sensitive material, e.g., as described above for fiber 184. Alternatively or in addition, fibers 212 may include neutron-sensitive material 147 in the material of the fibers, as described above for fibers 145.

Figure 12:
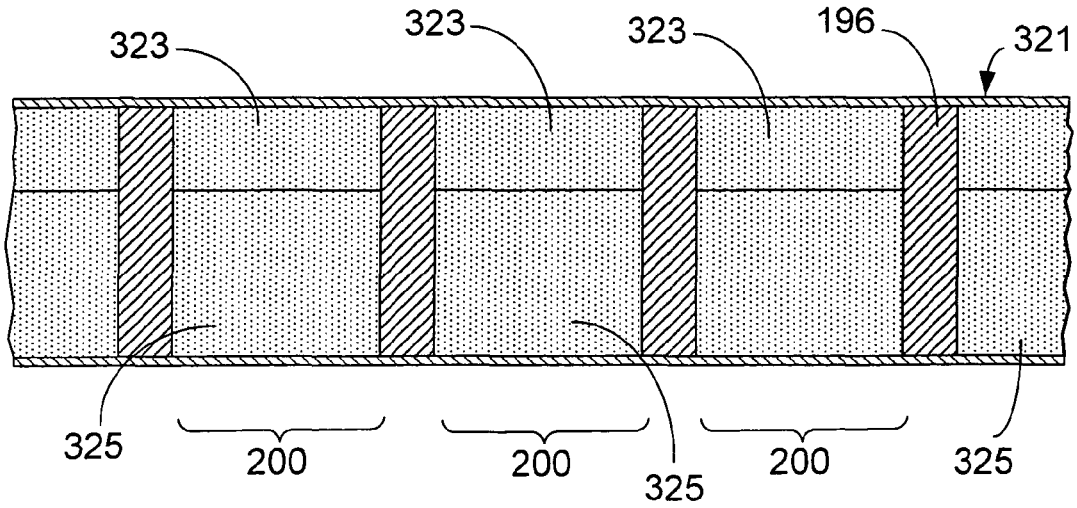
FIG. 12 is a cross-sectional view of an embodiment of a plate.

In other embodiments, channel(s) 200 can be filled with neutron-sensitive fibers and neutron-insensitive fibers. Referring to FIG. 12, channels 200 are filled near input side 321 with neutron-sensitive fibers 323 and neutron-insensitive fibers 325. Neutron-sensitive fibers 323 can be generally the same as fibers 145 and/or 184; and neutron-insensitive fibers 325, can be, for example, lead glass fibers as described above. Neutron-sensitive fibers 323 can reduce reverse ion flow, and neutron-insensitive fibers 325 can propagate an electron cascade through channels 200.

Fibers 323 and 325 can fill an entire channel 200, or a portion of the channel, e.g., less than about 100%, 90%, 80%, 70%, 60%, 50%, 40%, 30%, 20% or 10% of the length of the channel, and/or greater than about 0%, 10%, 20%, 30%, 40%, 50%, 60%, 70%, 80% or 90% of the length of the channel. Fibers 323 make up a portion of the combination of particles 323 and 325, e.g., less than about 100%, 90%, 80%, 70%, 60%, 50%, 40%, 30%, 20% or 10%, and/or greater than about 0%, 10%, 20%, 30%, 40%, 50%, 60%, 70%, 80% or 90%.

For all embodiments, an external layer of neutron-sensitive material 147 may cover the input surface or front face of a multiplier. The thickness of material 147 can be a function of the neutron sensitive material, and can be nominally in the escape range of a neutron-induced particle or less, e.g., to enhance the efficiency of the multiplier. For example, if material 147 includes $^{10}B$ metal, then the thickness can be approximately 4 microns. The external layer may have a thickness greater than the escape range of the neutron-induced particles. The external layer may or may not be bonded to the top of the device, but the external layer can be within an evacuated volume of the multiplier. The top side of the external layer need not be in vacuum, e.g., only the side of the layer facing the device is in vacuum. The spacing between the external layer and the top of the multiplier is preferably relatively low, e.g., minimized, to reduce the spread of neutron-induced particles across the face of the multiplier. The neutron-induced particles from the external layer that impinge upon the multiplier can create electron cascades. The neutron-induced particles from the external layer can enhance the efficiency of the device.

In other embodiments, the external layer includes a neutron moderator material that creates a reduced number of neutron-induced conversion reactions. The neutron moderator material can slow the neutrons by removing energy through interactions that do not absorb the neutron, i.e., moderation. As a result, the neutrons are preserved and can interact as relatively low energy neutrons in a multiplier. Slowing the neutrons can increase the likelihood that the neutrons can interact and produce charged particles near the top surface of the multiplier or in the multiplier. Examples of neutron moderator materials include materials with high concentrations of hydrogen, e.g., Nylon™, or beryllium. The thickness of the external layer can be proportional to the energy of the incident neutron, e.g., the higher the energy of the neutron striking the external layer, the thicker the layer. The thickness can range from a few mm to a few cm.

In other embodiments, the external layer includes both a neutron-sensitive material layer and a neutron moderator material. The materials can be combined, e.g., layered and/or intimately mixed. The thickness of the layer can be such that the emission of particles from the layer into a device is maximized.

In other embodiments, structural support, such as support 116, can be attached to plates of electron multipliers to increase the durability and strength of the multipliers.

In some embodiments, fibers include a core including lead (Pb) for enhanced hard X-ray and/or gamma ray detection. For X-ray energies greater than about 10 keV, an X-ray photon can interact with lead atoms in the bulk of the fibers and can release photoelectrons. The primary electrons can generate low energy (e.g., <50 eV) secondary electrons, which can escape the particle and initiate electron avalanches within a detector. Fibers having a core including lead can be modified as described above. For example, the fibers can similar to fibers 32, fibers 145, or fibers 184 having layer 192. The lead-containing particles can be used in any of the embodiments of multipliers described above, and modified accordingly, e.g., having an external layer.

Figure 13A:
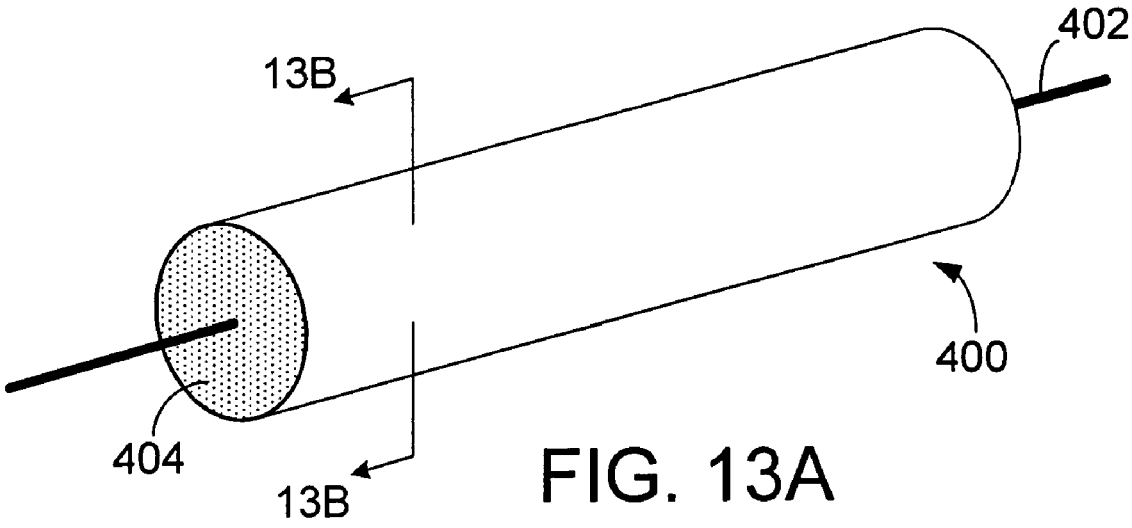
FIG. 13A is an illustration of an embodiment of a detector.
Figure 13B:
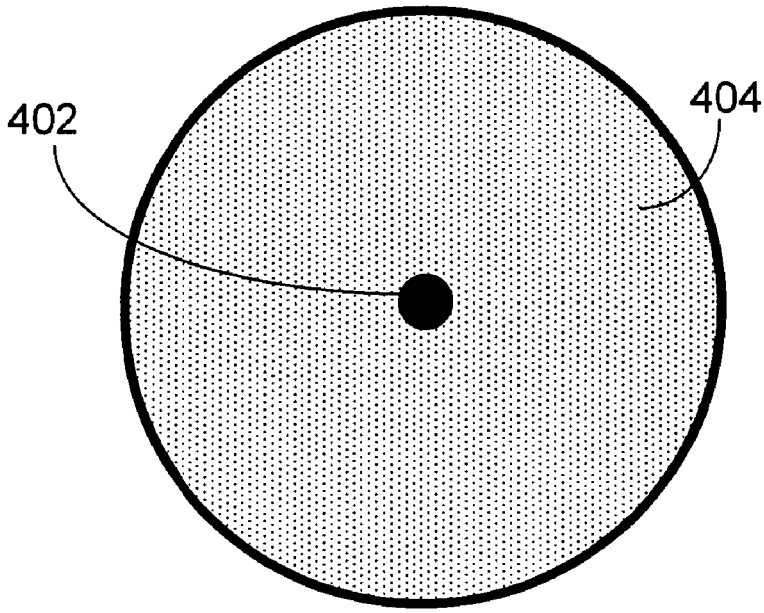
FIG. 13B is a cross-sectional view of the detector of FIG. 13B, taken along line 13B-13B.

Any of the fibers or reticulated structures can also be used in a cylindrical detector having a center positive electrode. Referring to FIGS. 13A and 13B, a cylindrical detector 400 includes a high voltage (about 1-2 KV) center wire 402 surrounded by a reticulated structure 404 (e.g., about 2 to 7 mm in diameter) as described above. Center wire 402 is electrically bonded to structure 404 to function as a positive electrode, a charge collector, and a readout. Structure 404 is bonded such that its cells and channels are open to allow an electron cascade to strike wire 402. Detector 400 is enclosed in a vacuum, with the outer surface of reticulated structure 404 being electrically grounded or more negative than the center wire by approx 1-2 KV. Electronic readout can be operated as a position sensitive device or a simple radiation pulse detector. The readout can be analogous to that used in $^{3}He$ gas tube detectors, so that detector 400 can substitute for $^{3}He$ gas tubes in existing instruments. Detector 400 is capable of having a decreased electron cloud pulse width that impacts along wire 402 from a single neutron event, e.g., compared to $^{3}He$ gas tube detectors. In addition to a shorter electrical pulse duration (drift time), detector 400 can have a stronger signal pulse (e.g., more electrons (e.g., about 100 times) per pulse event), e.g., compared to an event in the gas tube.

During use, incident particles (such as neutrons) pass through the outer surface of structure 404 and strike the structure. The incident particles are converted to charged particles, which initiate an electron multiplication cascade. The cascade is accelerated to center wire 402, where it is collected and detected. In other embodiments, the voltage polarity can be reversed to collect the cascade at the outer perimeter of the detector rather than at its center.

Figure 14:
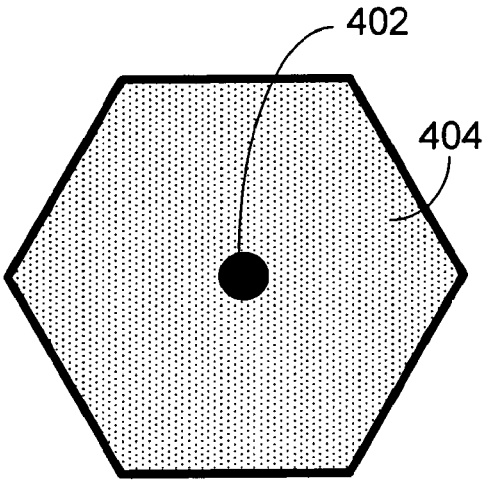
FIG. 14 is a cross-sectional view of an embodiment of a detector.
Figure 15:
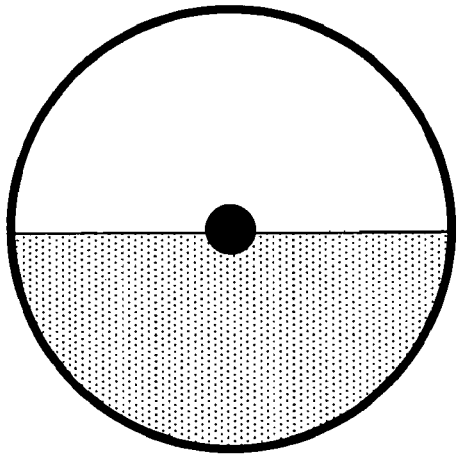
FIG. 15 is a cross-sectional view of an embodiment of a detector.
Figure 16:
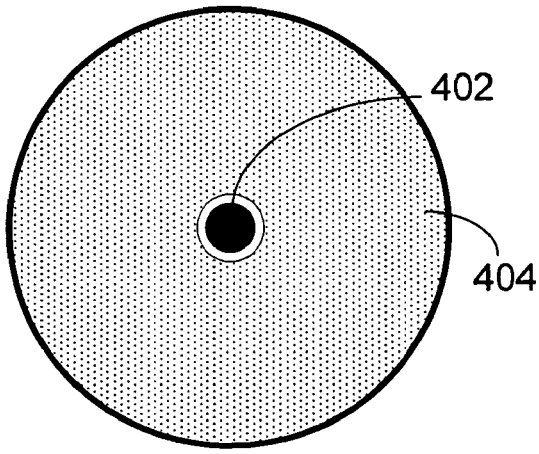
FIG. 16 is a cross-sectional view of an embodiment of a detector.

Other embodiments of detector 400 are possible. For example, in other embodiments, reticulate structure 404 can have a non-circular cross section, such as a polygonal cross section (FIG. 14), an oval cross section, or an elliptical cross section. The thickness of structure can be uniform or non-uniform along the length of wire 402. Reticulated structure 404 may not completely surround wire 402. For example, referring to FIG. 15, reticulated structure 404 surrounds half of wire 402, with the other half 406 of the wire enclosed in a vacuum. Alternatively, the enclosure can be flat to form a half cylinder. In some embodiments, referring to FIG. 16, reticulated structure 404 is electrically separated (e.g., spaced) from wire 402. The inner surface of reticulated structure 404 can include an electrode coating that is held at a more positive charge than wire 402 so that the wire attracts the electron cascade pulse generated. Reticulated structure 404 can be replaced with a microfiber plate or a microsphere plate.

Figure 17:
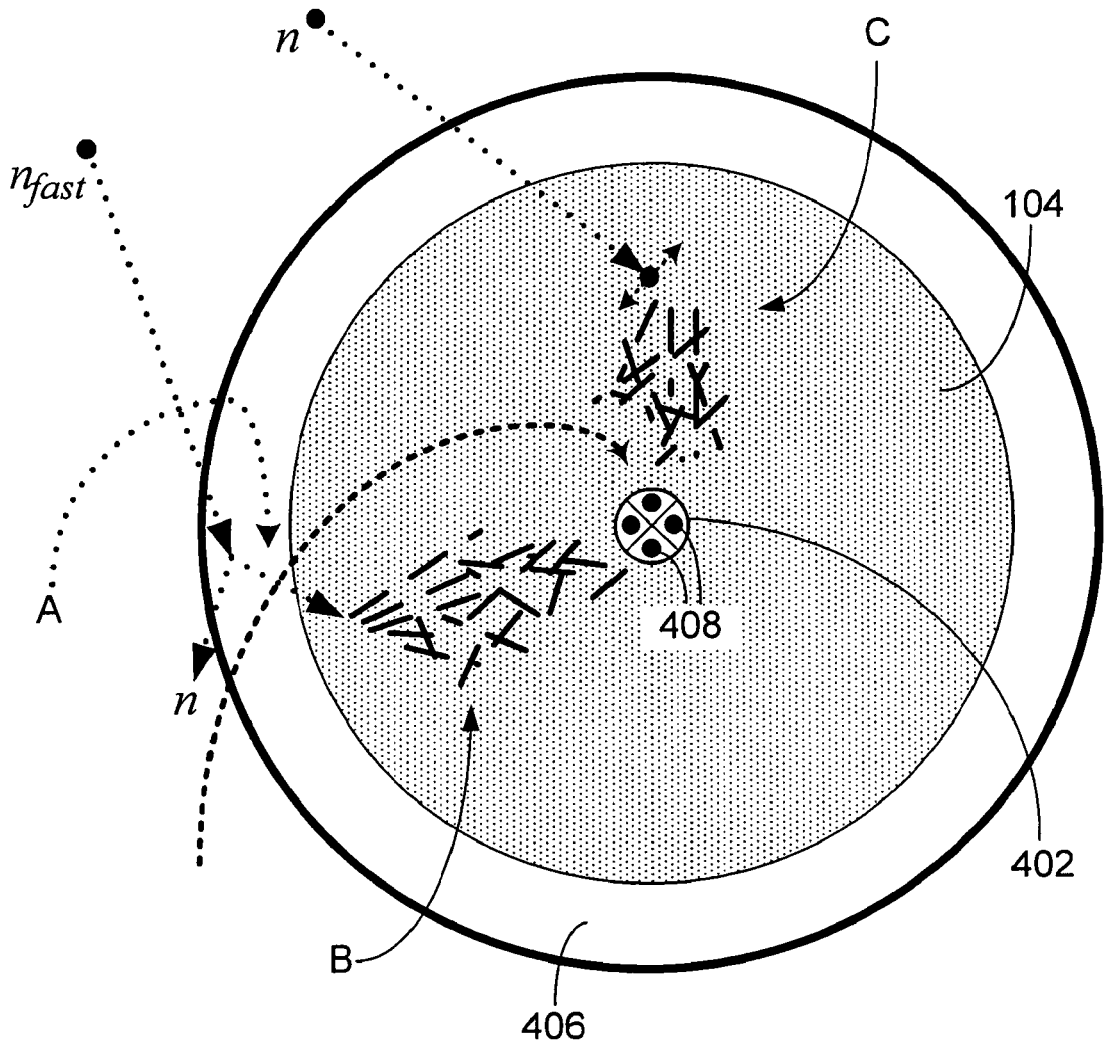
FIG. 17 is a cross-sectional view of an embodiment of a detector.

In still other embodiments, referring to FIG. 17, detector 400 can include a layer 406 for knock-on detection and/or sectional, position sensitive detection (PSD) capabilities. As shown, layer 406 surrounds reticulated structure 404 and is enclosed in the vacuum. Layer 406 can include a hydrogenous material such as a polymer having a high concentration of hydrogen atoms, e.g., high-density polyethylene, or Nylon™ During use, fast neutrons can knock out protons from layer 406 (step A), and the protons can travel through reticulated structure 404, where it generates an electron multiplication cascade (step B). At the same time, other incident particles (such as neutrons) pass through the outer surface of structure 404 and strike the structure. The incident particles are converted to charged particles, which initiate an electron multiplication cascade (step C). The cascade is accelerated to center wire 402, where it is collected and detected.

As shown in FIG. 17, wire 402 includes a plurality of electrically separated positive electrodes 408 (as shown, four electrodes). Electrodes 408 are capable of providing detector spatial resolution. One or more electrodes 408 can be monitored to indicate which quadrant of the cylinder has incurred a reaction, while the position sensitive detection (PSD) readout can provide where along the length and which side of the detector the cascade is detected.

Figure 18:
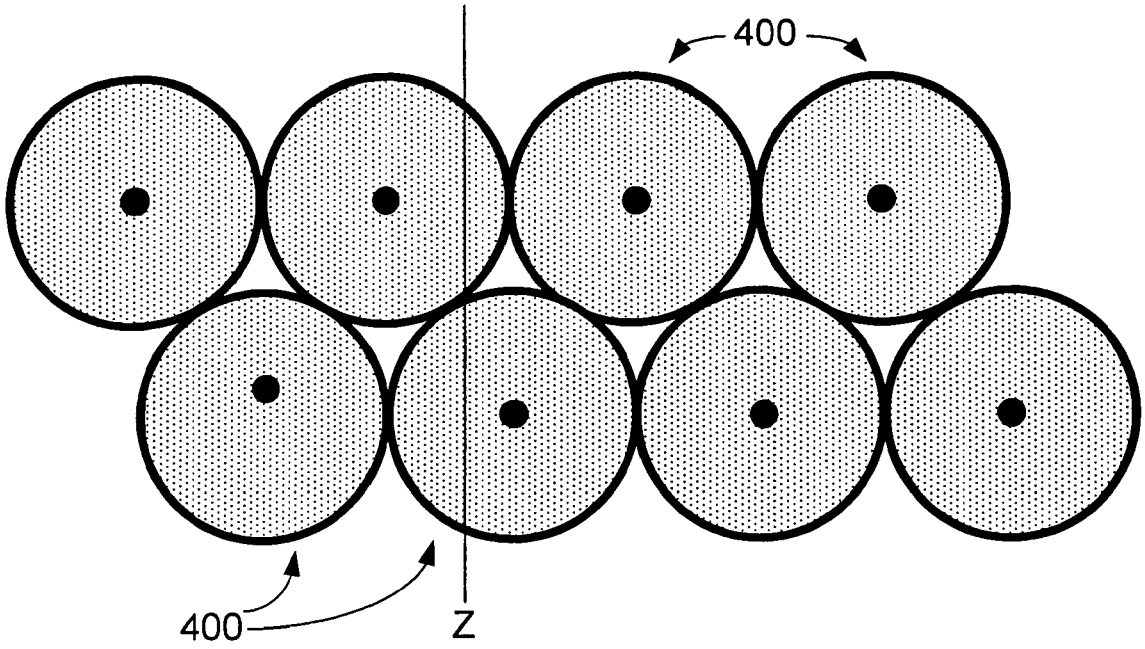
FIG. 18 is a cross-sectional view of an embodiment of an array of detectors.

FIG. 18 shows that the cylindrical detectors described above can be arranged in an array. Certain detector shapes or stacking patterns may provide an apparent uniform thickness of detector sensitive regions for particles traveling in the direction shown (arrow Z).

The fibers and structures described herein can be used in other MCP applications, such as in combination with photocathodes (for example, to detect light) and MALDI mass spectrometry.

As indicated above, embodiments of detector 400 can include any of the particles (e.g., fibers) or reticulated structured described above, including the fibers, spheres, and shards described in U.S. Ser. No. 10/138,854.

The fibers can be generally elongated structures having lengths greater than widths or diameters. The fibers can have a length of about 0.1 mm to about 50 mm. In some embodiments, The fibers can have a length greater than about 0.1 mm, 0.5 mm, 1 mm, 5 mm, 10 mm, 15 mm, 20 mm, 25 mm, 30 mm, 35 mm, 40 mm, or 45 mm; and/or less than about 50 mm, 45 mm, 40 mm, 35 mm, 30 mm, 25 mm, 20 mm, 15 mm, 10 mm, 5 mm, 1 mm, or 0.05 mm. The lengths of the fibers may be uniform or relatively random. For example, a 20-micron diameter fiber can include one or more lengths from about 0.3 mm to 10 mm in length. Relatively long fibers can be used for large plates, but relatively short fibers may provide resistance to coiling and a uniform plate. In some embodiments, fibers of long, continuous lengths can be loosely weaved to provide uniform and large plates, as in fiberglass cloth loom processing known in the fiberglass industry. The fibers can be a width of about 0.3 to 100 microns although other widths are possible in other embodiments, e.g., where the glass composition is modified as discussed below. The fibers can have a width greater than about 0.3, 1, 5, 10, 15, 20, 25, 30, 35, 40, 45, 50, 55, 60, 65, 70, 75, 80, 85, 90, or 95 microns; and/or less than about 95, 90, 85, 80, 75, 70, 65, 60, 55, 50, 45, 40, 35, 30, 25, 20, 15, 10, 5, or 1 micron. The width can be uniform or relatively random.

In some embodiments, the fibers have length to width aspect ratios from about 50:1 to about 3,000:1, although higher aspect ratios are possible. In some embodiments, the length to width aspect ratios can be greater than about 50:1, 100:1, 500:1, 1,000:1, 1,500:1, 2,000:1, or 2,500:1; and/or less than about 3,000:1, 2,500:1, 2,000:1, 1,500:1, 1,000:1, 500:1, or 100:1. The width used to determine the aspect ratio can be the narrowest or broadest width. The length can be the largest dimension of a fiber. Mixtures of fibers having two or more different aspect ratios and/or dimensions can be used in a detector.

The fibers can have a variety of configurations or shapes. The fibers can have a cross section that is circular or non-circular, such as oval, or regularly or irregularly polygonal having 3, 4, 5, 6, 7, or 8 or more sides. The outer surface of the fibers can be relatively smooth, e.g., cylindrical or rod-like, or faceted. The fibers can have uniform or non-uniform thickness, e.g., the fibers can taper along their lengths. Mixtures of fibers having two or more different configurations or shapes can be used in a detector. In other embodiments, thin, flat shard-like fibers having irregular shapes can be used. Spherical particles can be combined with fibers.

The fibers can include glass combined with lead and/or a surface that is semi-conductive and electron-emissive, generally as described above.

In some embodiments, reticulated structure 404 has a void volume percentage of about 25% to about 90%, e.g., greater than about 25%, 30%, 35%, 40%, 45%, 50%, 55%, 60%, 65%, 70%, 75%, 80%, or 85% and/or less than about 85%, 80%, 75%, 70%, 65%, 60%, 55%, 50%, 45%, 40%, 35%, or 30%.

Alternatively or additionally, the particles can include spheres and/or shards. In embodiments, the spheres can have a diameter about 10 microns to about 100 microns, e.g., 25 microns to about 50 microns. Similarly, shards can have a largest dimension as described above for sphere diameters, e.g., about 10 microns to about 100 microns. The particles can be relatively small to enhance alpha or beta particle escape, while the interstitial spacing of the particles is relatively large to enhance electron multiplication. In some embodiments, the spheres, fibers, or shards are hollow, which may enhance alpha or beta particle escape from the interior.

The particles can include a neutron sensitive material as generally described above.

The chemical composition of the fiber, sphere, or chard may be varied according to distance from the outer surface of the particle. By decreasing the amount of neutron-sensitive material at depths where neutron-induced reaction products (charged particles, neutrals, and electrons) would be unable to escape to the surface and where such depths exceed the range of these reaction products, a chemical gradient is formed within the particle. Establishing this gradient or preferential layer enriched in neutron-sensitive material can increase the neutron detection efficiency of a detector by preventing neutrons from being absorbed at depths in the particle where they may not be effective and where the reaction products may be unable to escape and thus not contribute to the detection process. This can effectively increase the number of neutrons passing through the particle and increase the probability of such surviving neutrons interacting with other particles. The percentage of neutrons interacting with a given particle that yield a reaction product that escapes the particle to form an avalanche may also be increased.

The particles can be formed by glass processing procedures. Shards can be formed by breaking relatively large pieces of glass into progressively smaller pieces, for example, by hammering, grinding, and/or crushing the glass in a mortar and pestle, and sieving with standard screens to the desired sizes. Filtering processes can screen out excessively large and/or excessively fine particles to obtain shards of a desired size. Size differences can be controlled to within about 7-10 microns. Spheres can be formed by taking the sized shards and further processing them through a high temperature flame, which makes the shards spherical. The resultant spheres are then sieved again to the desired sizes. Fibers can be made by heating a cylindrical preform in a high temperature furnace and pulling a small diameter fiber from the heated glass cylinder. The diameter of the fiber can be controlled, e.g., by controlling the speed of fiber pull and the temperature of the furnace. A small diameter fiber can be wound onto a drum and cut to a desired length.

Other embodiments are within the claims.

What is claimed is:

1. An electron multiplier, comprising:

an elongated electrode; and a structure surrounding a portion of a cross section of the electrode, the structure comprising randomly interconnected fibers, shards, or spheres.

2. The multiplier of claim 1, wherein the electrode is a wire.

3. The multiplier of claim 1, wherein the structure completely surrounds a cross section of the electrode.

4. The multiplier of claim 1, wherein the structure is spaced from the electrode.

5. The multiplier of claim 1, further comprising a hydrogen-containing material on a portion of the structure.

6. The multiplier of claim 5, wherein the hydrogen-containing material comprises a polymer.

7. The multiplier of claim 1, comprising a plurality of electrodes.

8. The multiplier of claim 7, wherein the electrodes are symmetrically arranged about a cross section of the multiplier.

9. The multiplier of claim 1, wherein the electrode and the structure are coaxial.

10. The multiplier of claim 1, wherein the structure has a circular cross section.

11. The multiplier of claim 1, wherein the structure has a polygonal cross section.

12. The multiplier of claim 1, wherein the structure comprises a neutron sensitive material.

13. The multiplier of claim 1, wherein the structure comprises an electron emissive material.

14. The multiplier of claim 1, wherein the structure comprises lead.

15. The multiplier of claim 1, wherein the electrode is a negative electrode.

16. The multiplier of claim 1, wherein the electrode is a positive electrode.

17. A microchannel plate comprising:

a plate having an array of channels, each channel having a surface layer that is semi-conductive and electron emissive, the plate comprising hydrogen-containing material in which energetic protons are released and secondary electrons are produced within the plate when neutrons strike the hydrogen-containing material.

18. The microchannel plate of claim 17 in which the hydrogen-containing material comprises a polymer that comprises hydrogen atoms.

19. The microchannel plate of claim 17 in which the hydrogen-containing material comprises at least one of high-density polyethylene, nylon, or polyaramid.

20. The microchannel plate of claim 17 in which the channels are oriented normal to an input side and an output side of the plate.

21. An electron multiplier comprising:

a porous plate between a first electrode and a second electrode, the plate having a structure that defines openings within the plate, the structure having surfaces that comprise neutron-sensitive material, the plate comprising hydrogen-containing material in which energetic protons are released and secondary electrons are produced within the plate when neutrons strike the hydrogen-containing material.

22. The electron multiplier of claim 21 in which the hydrogen-containing material comprises at least one of high-density polyethylene, nylon, or polyaramid.

23. The electron multiplier of claim 21 in which the hydrogen-containing material comprises a polymer that comprises hydrogen atoms.

24. The electron multiplier of claim 21 in which the openings comprise channels that are oriented normal to an input side and an output side of the plate.

* * * * *

UNITED STATES PATENT AND TRADEMARK OFFICE

CERTIFICATE OF CORRECTION

PATENT NO. : 7,990,032 B2
APPLICATION NO. : 12/409297
DATED : August 2, 2011
INVENTOR(S) : R. Gregory Downing et al.

It is certified that error appears in the above-identified patent and that said Letters Patent is hereby corrected as shown below:

Cover page, item (73) Assignee:, delete "Starbridge," and insert -- Sturbridge, --.

Cover page, col. 2, under OTHER PUBLICATIONS, line 1, delete "Leiceister," and insert -- Leicester --.

Cover page, col. 2, under OTHER PUBLICATIONS, line 2, delete "sre." and insert -- src. --.

Signed and Sealed this
Twenty-seventh Day of September, 2011

David J. Kappos

David J. Kappos
*Director of the United States Patent and Trademark Office*